US006522842B1

(12) United States Patent
Uehara et al.

(10) Patent No.: US 6,522,842 B1
(45) Date of Patent: Feb. 18, 2003

(54) DEVELOPING APPARATUS AND IMAGE FORMING APPARATUS

(75) Inventors: Shinji Uehara, Susono; Yasuyuki Ishii; Tomomi Kakeshita, both of Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/663,395

(22) Filed: Sep. 15, 2000

(30) Foreign Application Priority Data

Sep. 22, 1999 (JP) ..... 11-269522
Aug. 30, 2000 (JP) ..... 2000-261520

(51) Int. Cl.[7] ..... G03G 15/06; G03G 15/30

(52) U.S. Cl. ..... 399/55; 399/149; 399/281; 399/284

(58) Field of Search ..... 399/55, 270, 271, 399/272, 274, 281, 284, 285

(56) References Cited

U.S. PATENT DOCUMENTS 4,896,193 A 1/1990 Kagiura et al.
5,592,266 A * 1/1997 Park et al. ..... 399/284
6,314,257 B1 * 11/2001 Ishii ..... 399/150

FOREIGN PATENT DOCUMENTS

| | | |
|---|---|---|
| EP | 0 908 793 | 4/1999 |
| JP | 11-119546 | 4/1999 |
| JP | 11-119547 | 4/1999 |

* cited by examiner

*Primary Examiner*—Hoang Ngo
(74) *Attorney, Agent, or Firm*—Fitzpatrick, Cella, Harper & Scinto

(57) ABSTRACT

In a developing apparatus having the configuration of charging toner on the developing roller with the toner charging roller, toner charging roller contacts to the developing roller. Since toner adheres onto the toner charging roller by applying the voltage higher than a starting voltage in the developing apparatus, electrifying property of the toner charging roller drops. This causes low image quality since stable charges cannot be given to the toner on the developing roller. Therefore, they are provided, a developing apparatus and an image forming apparatus that can always offer good image quality by preventing adhesion of a developing material to a developer-charging member and always giving stable charges to a developer bearing body and developer.

39 Claims, 15 Drawing Sheets

T1: [DISTANCE BETWEEN CHARGING ROLLER AND DEVELOPING ROLLER, CORRESPONDING TO CIRCUMFERENTIAL LENGTH OF A DRUM]/[PROCESSING SPEED]

T2, T3,: TIME CORRESPONDING TO ONE REVOLUTION OF A TONER CHARGING ROLLER

T1: [DISTANCE BETWEEN CHARGING ROLLER AND DEVELOPING ROLLER, CORRESPONDING TO CIRCUMFERENTIAL LENGTH OF A DRUM]/[PROCESSING SPEED]

T2, T3,: TIME CORRESPONDING TO ONE REVOLUTION OF A TONER CHARGING ROLLER

UNDER DEVELOPMENT SEQUENCE

UNDER CLEANING SEQUENCE

DEVELOPING APPARATUS AND IMAGE FORMING APPARATUS

BACKGROUND OF THE INVENTION

1. Field of the Invention

The present invention relates to a developing apparatus which forms a developer image by making developer adhere to an electrostatic latent image formed on an image bearing body, and an image forming apparatus such as a copying machine, a printer, or facsimile equipment that performs image formation by an electrographic system and has the above-described developing apparatus.

2. Related Background Art

Various kinds of developing apparatuses are proposed as a developing apparatus used for an image forming apparatus in each electrographic system. For example, recently, an apparatus performing developing in the configuration of pushing a semiconductive roller or a developing roller, having a dielectric layer on its surface, to a surface layer of a photosensitive body, that is, a contact-one-component-type developing apparatus is proposed.

FIG. 16 is a schematic structural diagram showing an image forming apparatus having a conventional contact-one-component-type developing apparatus (hereinafter, this is simply called a developing apparatus) (this image forming apparatus is an electrographic laser beam printer).

A present image forming apparatus has a drum-type electrographic photosensitive body (hereinafter, a photosensitive drum) 1 as an image bearing body. Around the photosensitive drum 1, a charging roller 2, a developing apparatus 3, a transfer roller 4, and a cleaning blade 5 are arranged, and an exposure device 6 is located outside between the developing device 3 and cleaning blade 5. Furthermore, in the downstream in a transferring material conveying direction of a transferring nip between the photosensitive drum 1 and transfer roller 4, a fixing device 7 is located.

In this embodiment, the photosensitive drum 1 is an organic photosensitive body negatively charged and has a photosensitive body layer (not shown) on an aluminum drum base (not shown), is rotatably driven in predetermined peripheral speed in the direction shown by an arrow A (clockwise), and is uniformly charged in a negative polarity by the charging roller 2 contacting in the rotational process.

The charging roller 2 as charging means rotatably contacts to a surface of the photosensitive drum 1, and uniformly charges the photosensitive drum 1 in predetermined polarity and electric potential by a charging bias applied from a charging bias supply (not shown).

The developing apparatus 3 is a contact-one-component-type developing apparatus performing developing with non-magnetic toner t as one-component developer. The developing apparatus 3 includes a developing roller 11 as a developer bearing body which is located in an opening section of a developing container 10 with facing the photosensitive drum 1 and can be rotate in the direction shown by an arrow (counterclockwise), an elastic roller 12 that can rotate and contacts to the developing roller 11 with pressing the developing roller 11, a control blade 13 that has elasticity and contacts to the developing roller 11, and an agitating member 14 agitating the toner t. The control blade 13 contacts to the developing roller 11 for a press-contacting section of the developing roller 11 and elastic roller 12 in the downstream in a rotational direction of the developing roller 11. The elastic roller 12 rotates in the direction shown by an arrow (clockwise).

The toner t agitated by the agitating member 14 is supplied to a surface of the developing roller 11 by the elastic roller 12 rotating with pressing the developing roller 11. The toner supplied to the surface of the developing roller 11 is conveyed in connection with the rotation of the developing roller 11, is charged by friction in a contacting section of the control blade 13 and developing roller 11, and is laminated on a surface of the developing roller 11. The toner laminated is conveyed by the rotation of the developing roller 11, and manifests an electro static latent image with adhering to the electro static latent image formed on the photosensitive drum 1 in the contacting section with the photosensitive drum 1 (developing section). In addition, toner which does not contribute to the developing on the developing roller 11 is scraped off by the elastic roller 12.

The transferring roller 4 as transferring means forms a transferring nip with contacting to the surface of the photosensitive drum 1 in predetermined pressure, and transfers a toner image on the surface of the photosensitive drum 1 to a transferring material P in the transferring nip between the photosensitive drum 1 and transferring roller 4 with a transferring bias applied from a transferring bias supply (not shown). The transferring roller 4 is rotated in the direction shown by an arrow (counterclockwise).

The cleaning blade 5 removes waste toner that is left on the surface of the photosensitive drum 1 after transferring.

The exposure device 6 includes a laser driver, a laser diode, a polygon mirror, and the like that are not shown. The exposure device 6 forms an electro static latent image corresponding to image information by outputting from the laser diode a laser beam modulated corresponding to a time series electric digital image signal of the image information inputted into the laser driver, scanning the above-described laser beam with the polygon mirror rotating in high speed, and performing image exposure L of the surface of the photosensitive drum 1 through a reflecting mirror (not shown).

The fixing device 7 has a fixing roller 7*a* and a pressure roller 7*b* which can freely rotate, and thermally fixes the toner image transferred on a surface of the transferring material P in the fixing nip between the fixing roller 7*a* and pressure roller 7*b* by heating and pressurizing the toner image with sandwiching and conveying the transferring material P.

Next, image-forming operation by the above-described image forming apparatus will be described.

In image formation, the photosensitive drum 1 is rotationally driven in predetermined peripheral speed in the direction shown by an arrow A by driving means (not shown), and its surface is uniformly charged by the charging roller 2.

In addition, image exposure L is given by the exposure device 6 on the photosensitive drum 1 that is charged, and an electro static latent image according to image information that is inputted is formed.

Furthermore, as described above, the electro static latent image formed on the photosensitive drum 1 is manifested as a toner image by bonding toner charged in the same polarity as the charged polarity of the photosensitive drum 1 (negative polarity) by the developing roller 11 of the developing apparatus 3 where a developing bias in the same charged polarity as the charged polarity of the photosensitive drum 1 (negative polarity) is applied in a developing section.

Moreover, when the toner image on the photosensitive drum 1 arrives at the transferring nip between the photosensitive drum 1 and transferring roller 4, the transferring materials P such as paper in a cassette 15 is fed every sheet by a pickup roller 16 in accordance with this timing, and is conveyed in the transferring nip by a resist roller (not shown) and the like.

In addition, the toner image on the photosensitive drum 1 is transferred on the transferring material P, which is conveyed to the transferring nip by the transferring roller 4 where the transferring bias in the polarity reverse (positive polarity) to the polarity of the above-described toner is applied, by an electrostatic force occurring between the photosensitive drum 1 and transferring roller 4. Furthermore, the transferring material P where the toner image is transferred is conveyed to the fixing device 7, and is ejected to the outside through a paper output roller 17 after the toner image is thermally fixed by being heated and pressurized on the transferring material P in the fixing nip between the fixing roller 7*a* and pressure roller 7*b,* and then a series of image forming operation is finished.

Moreover, waste toner remaining on the surface of the photosensitive drum 1 after toner image transferring is removed by the cleaning blade 5, and is collected in a cleaning container 18.

In addition, recently, against the contact-one-component developing system described above, as disclosed in Japanese Patent Application Laid-Open No. 11-119546 and Japanese Patent Application Laid-Open No. 11-119547, so as to achieve high triboelectric stability and little fog, developing systems to use means for electrically toner charging with using each toner charging roller are proposed.

Here, a developing system using the toner charging roller is shown in FIG. 17. In addition, duplicated description will be omitted by assigning the same numerals to the parts that have the same functions as those in the developing apparatus of the image forming apparatus described above.

This developing apparatus has the toner charging roller 19 that contacts to the developing roller 11 and can freely rotate. A toner charging bias supply (not shown) is connected to the toner charging roller 19. Other configuration is the same as the above-described developing apparatus 3.

In developing operation by this developing apparatus, the toner t agitated by the agitating member 14 is supplied to a surface of the developing roller 11 by the elastic roller 12 rotating with pressing the developing roller 11. The toner supplied to the surface of the developing roller 11 is conveyed in connection with the rotation of the developing roller 11, is charged by friction in a contacting section of the control blade 13 and developing roller 11, and is laminated on a surface of the developing roller 11.

Furthermore, the toner on the developing roller 11 is charged by being given electric charges by the discharge of the toner charging roller 19 where the charging bias is applied. In addition, the laminated toner which is given the charges is conveyed by the rotation of the developing roller 11, adheres to an electro static latent image formed on the photosensitive drum 1 in a contacting section (a developing section) to the photosensitive drum 1, and manifests the electro static latent image.

By the way, as described above, in a developing apparatus having the configuration of charging toner on the developing roller 11 with the toner charging roller 19, the toner charging roller 19 contacts to the developing roller 11, and the toner adheres onto the toner charging roller 19 by applying the voltage higher than a starting voltage, and hence the electrifying property of the toner charging roller 19 drops.

Owing to this, there is such a problem that it is not possible to keep good image quality since stable charges cannot be given to the toner on the developing roller 11.

SUMMARY OF THE INVENTION

An object of the present invention is to provide a developing apparatus and an image forming apparatus that can always offer good image quality by preventing adhesion of a developing material to a developer-charging member and always giving stable charges to a developer bearing body and developer.

Another object of the present invention is to provide a developing apparatus and an image forming apparatus that can offer a stable image since it becomes possible to give charges to toner more stably than the above-described case by performing cleaning operation of a toner charging roller before and after image forming operation (developing operation).

Objects except above-described objects and characteristics of the present invention will become clear by reading the following detailed description with referring to accompanying drawings.

DESCRIPTION OF THE PREFERRED EMBODIMENTS

First Embodiment

Figure 1:
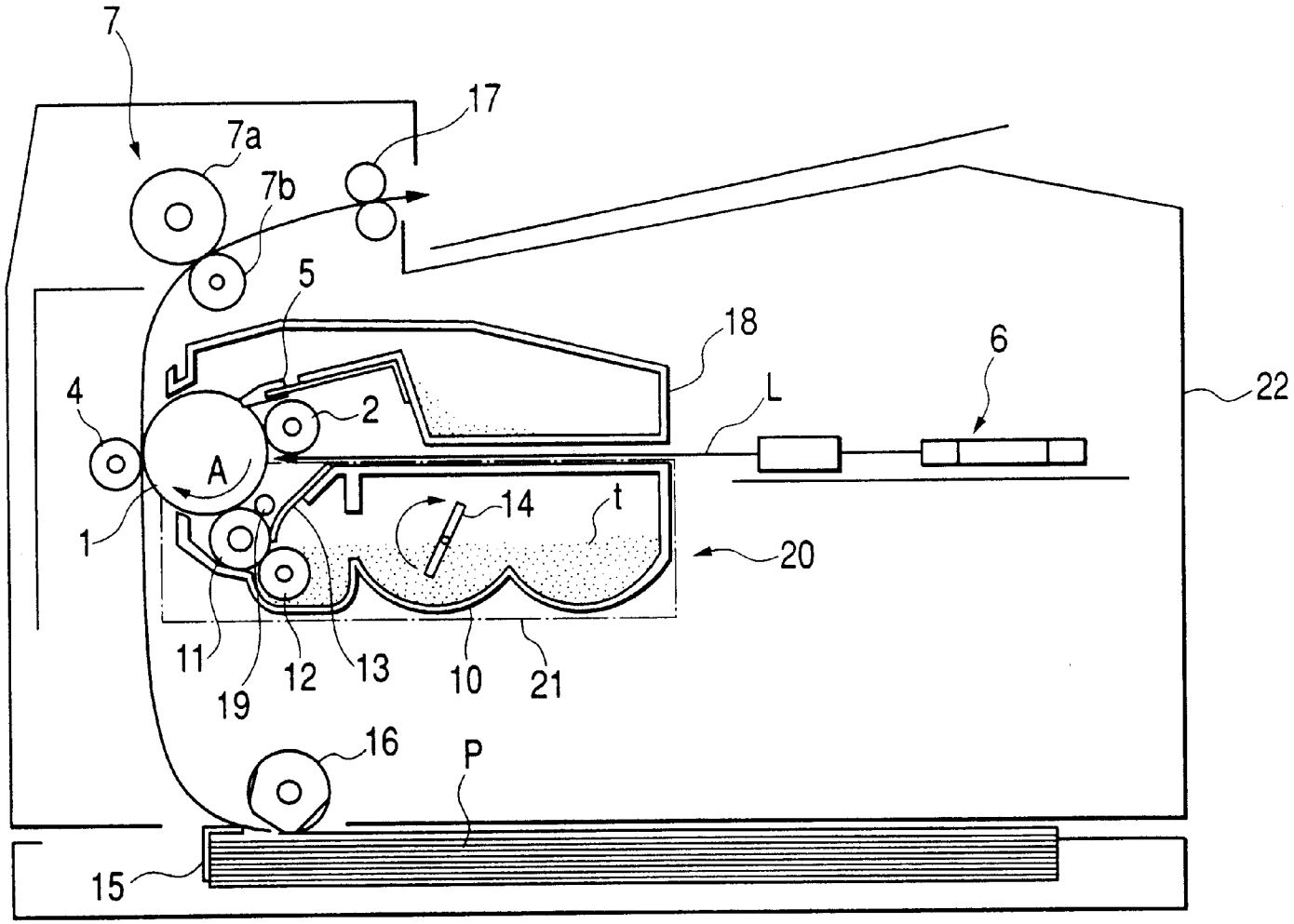
FIG. 1 is a schematic structural drawing showing an image forming apparatus including a developing apparatus according to a first embodiment of the present invention.
Figure 16:
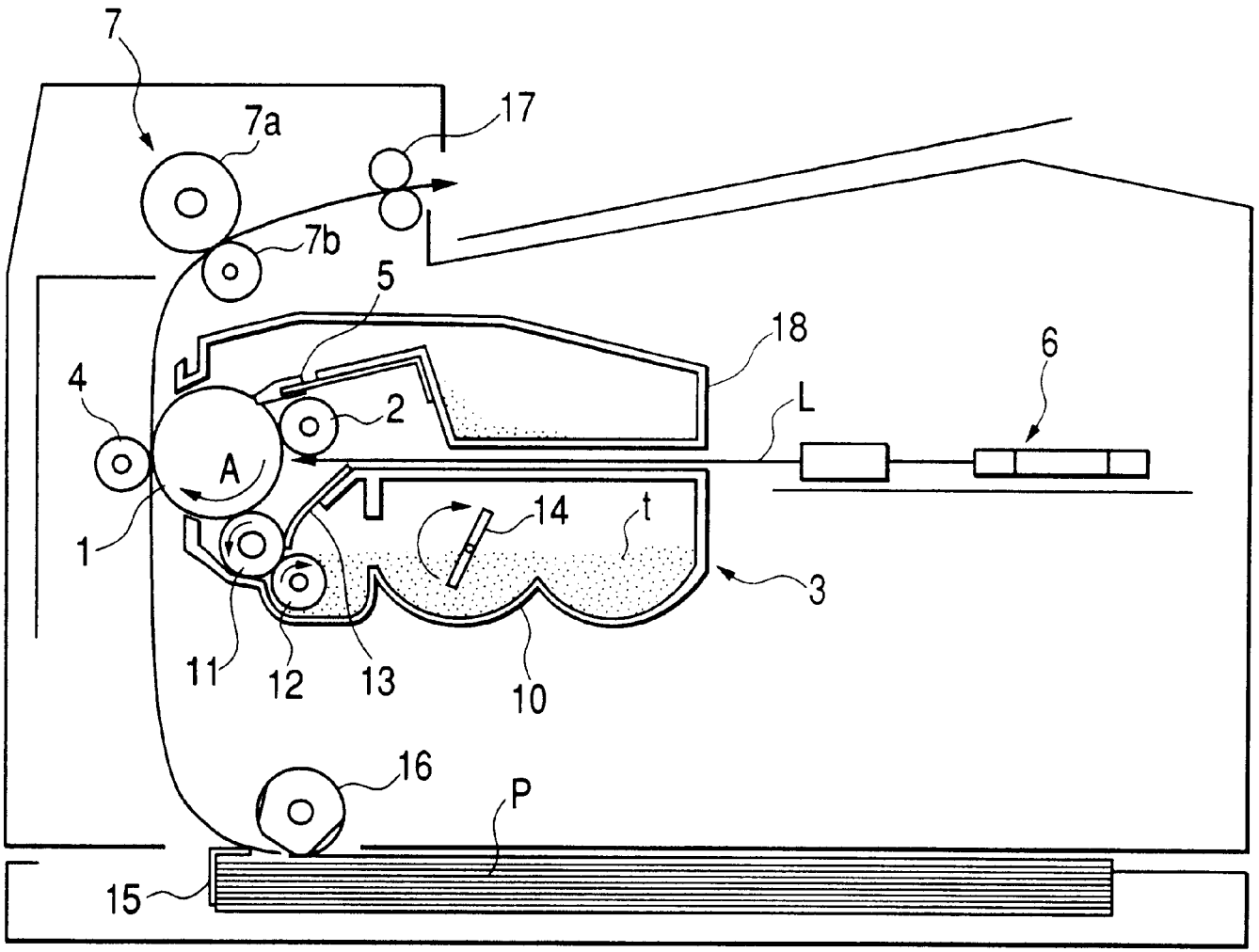
FIG. 16 is a schematic structural drawing showing an image forming apparatus including a developing apparatus in a conventional example.
Figure 17:
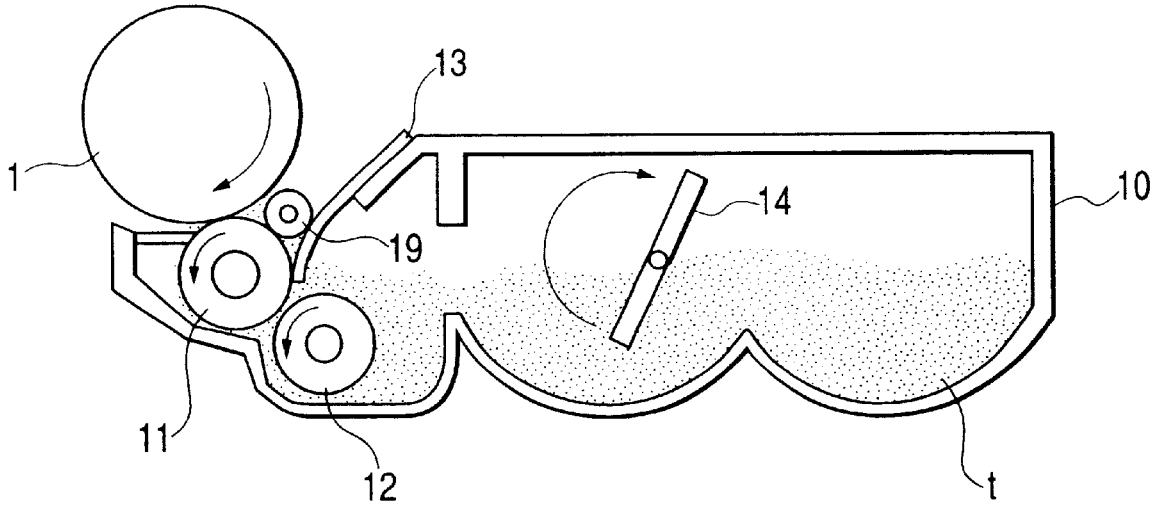
FIG. 17 is a schematic cross-sectional view of the developing apparatus in the conventional example.

FIG. 1 is a schematic structural drawing showing an image forming apparatus including a developing apparatus according to a first embodiment of the present invention. The developing apparatus of the image forming apparatus in this embodiment has a toner charging roller charging toner on a developing roller with contacting to a developing roller. In addition, duplicated description will be omitted by assigning the same numerals to the parts that are the same as those in the conventional image forming apparatus shown in FIG. 16 and the conventional developing apparatus shown in FIG. 17.

Also, in the image forming apparatus of this embodiment, similarly to the conventional example described above, an electro static latent image corresponding to input image information is formed by the image exposure L being given by the exposure device 6 onto the photosensitive drum 1 charged by the charging roller 2. Furthermore, the electro static latent image is manifested as a toner image by bonding non-magnetic toner, which is charged in the same polarity as the charged polarity of the photosensitive drum 1 (negative polarity) and is used as one-component developer, by the developing roller 11 of the developing apparatus 20 where a developing bias in the same charged polarity as the charged polarity of the photosensitive drum 1 (negative polarity) is applied in a developing section (detailed configuration and operation of the developing apparatus 20 in this embodiment will be described later).

Moreover, when the toner image on the photosensitive drum 1 arrives at the transferring nip between the photosensitive drum 1 and transferring roller 4, the transferring materials P such as paper in a cassette 15 is fed every sheet by a pickup roller 16 in accordance with this timing, and is conveyed in the transferring nip by a resist roller (not shown) and the like.

In addition, the toner image on the photosensitive drum 1 is transferred on the transferring material P, which is conveyed to the transferring nip by the transferring roller 4 where the transferring bias in the polarity reverse (positive polarity) to the polarity of the above-described toner is applied, by an electrostatic force occurring between the photosensitive drum 1 and transferring roller 4. Furthermore, the transferring material P where the toner image is transferred is conveyed to the fixing device 7, and is ejected to the outside through a paper output roller 17 after the toner image is thermally fixed by being heated and pressurized on the transferring material P in the fixing nip between the fixing roller 7*a* and pressure roller 7*b*. Moreover, waste toner remaining on the surface of the photosensitive drum 1 after toner image transferring is removed by the cleaning blade 5, and is collected in a cleaning container 18.

In addition, in this embodiment, the photosensitive drum 1 and developing apparatus 20 are configured in one piece in a process cartridge 21, and the process cartridge 21 is detachably mounted on an image forming apparatus body 22.

Next, a developing apparatus 20 according to this embodiment will be described.

Figure 2:
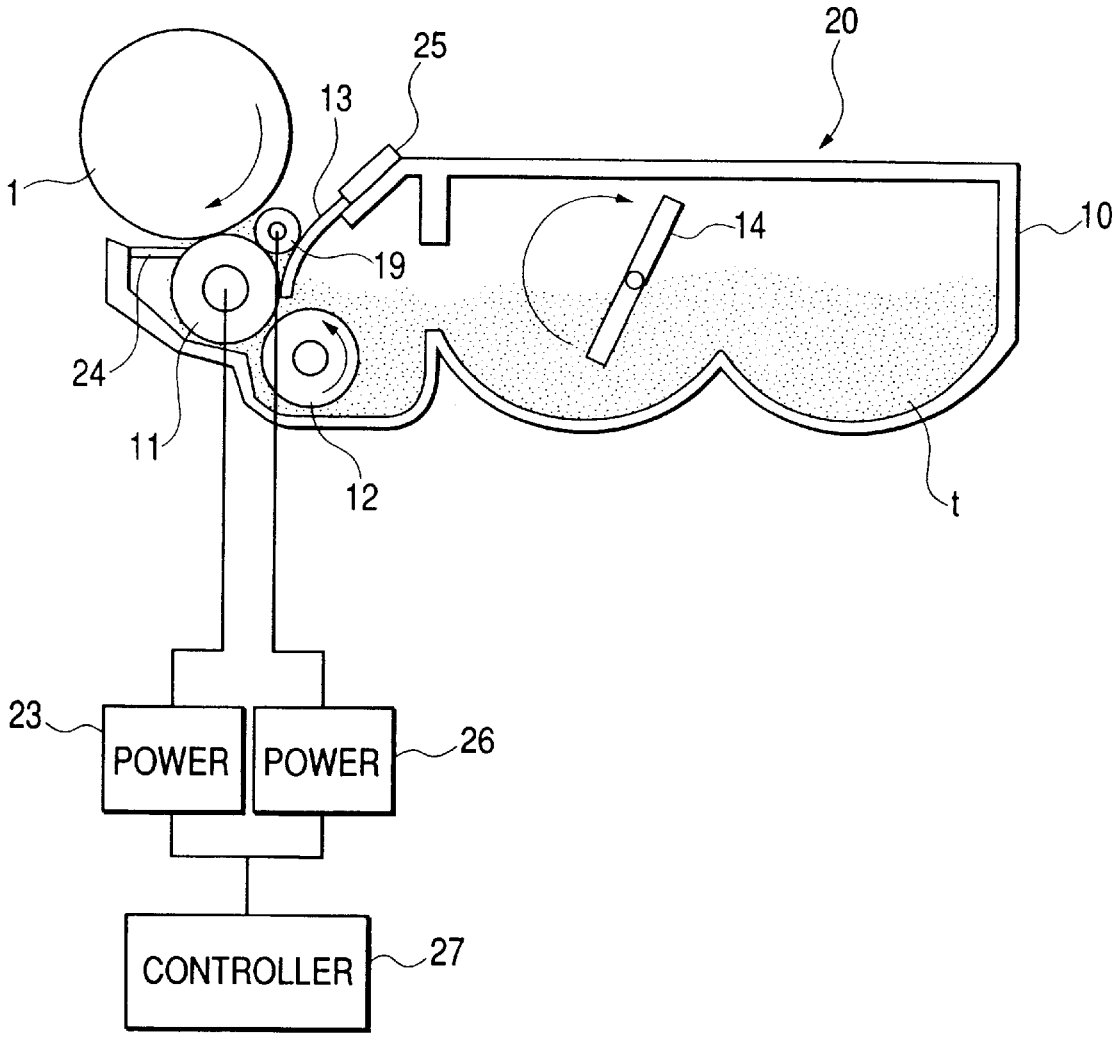
FIG. 2 is a schematic cross-sectional view of the developing apparatus accord to the first embodiment of the present invention.

This developing apparatus 3, as shown in FIGS. 1 and 2, includes a developing roller 11 which is located in an opening section of the developing container 10 with facing the photosensitive drum 1 and can be rotate in the direction shown by an arrow (counterclockwise), an elastic roller 12 that can rotate and contacts to the developing roller 11 with pressing the developing roller 11, a control blade 13 that has elasticity and contacts to the developing roller 11, an agitating member 14 agitating the toner t, and a toner charging roller 19 that contacts to the developing roller 11 and can freely rotate.

The developing roller 11 contacts to the photosensitive drum 1 with contacting width, and is rotated in peripheral speed (e.g., 80 mm/sec) a little bit faster than the peripheral speed of the photosensitive drum 1 (e.g., 50 mm/sec). A surface of the developing roller 11 has proper evenness so as to increase a slidable friction probability with the toner t and to smoothly convey the toner t, and in this embodiment, the developing roller 11 is configured with an acryl urethane film formed on a silicone rubber layer that is 16 mm in diameter, 216 mm long, and 5 mm thick. A developing bias supply 23 is connected to the developing roller 11, and applies a developing bias in a predetermined electric potential and polarity to the developing roller 11.

In addition, in this embodiment, the roller resistance of the developing roller 11 is made to be $10^4$ to $10^6\Omega$. Here, in the measurement of a resistance value of the developing roller 11, with contacting the developing roller 11 to a metal roller (not shown), which is made of aluminum and is 30 mm in diameter and 210 mm long in a longitudinal direction, in the contacting load of 500 gF, this metal roller is rotated in predetermined peripheral speed (e.g., 50 mm/sec). In addition, a DC voltage of 400 V is applied to the developing roller 11, and a resistor of 10 KΩ is arranged in a ground side. Furthermore, by measuring voltages at both ends of this resistor and obtaining a current value from the voltage measured, the resistance of the developing roller 11 is calculated.

Moreover, in a contacting section (a developing section) of the developing roller 11 with the surface of the photosensitive drum 1, a flexible seal member 24 is provided in the downstream in the rotational direction of the developing roller 11. The seal member 24 not only permits the pass of undeveloped toner into a developing container 10, but also prevents the toner t in the developing container 10 from leaking from the downstream in the rotational direction of the developing roller 11 in the contacting section of the developing roller 11 with the surface of the photosensitive drum 1.

The elastic roller 12 contacts to a contacting section of the control blade 13 with the surface of the developing roller 11 in the upstream of the rotational direction of the developing roller 11, and is rotatably supported.

It is preferable that the elastic roller 12 has formed skeletal sponge configuration or fur brush configuration of fibers such as rayon and nylon being transplanted on a core bar from the viewpoint of supply of toner t to the developing roller 11 and scrape of undeveloped toner. In this embodiment, an elastic roller 12 that is 16 mm in diameter and is made of polyurethane foam on a core bar is used. As contacting width of the elastic roller 12 with the developing roller 11, 1 to 8 mm is effective, and it is preferable to make the developing roller 11 have relative velocity in the contacting section. In this embodiment, the contacting width with the developing roller 11 is set in 3 mm, and so as to become 50 mm/sec (relative speed to the developing roller 11 is 130 mm/sec) in developing operation as the peripheral speed of the elastic roller 12, the elastic roller 12 is rotationally driven in predetermined timing by driving means (not shown).

The control blade 13 is supported by a blade supporting plate 25, and is provided so as to contact in the vicinity of an end section of a free end side to an outer peripheral surface of the developing roller 11 in planer contact and with elasticity. The control blade 13 is made of rubber material such as silicone and urethane, and sheet metal of SUS or phosphor bronze that has spring elasticity as a base, and is configured with bonding rubber material and the like in a contacting surface to the developing roller 11. In this embodiment, the control blade 13 is used, the control blade 13 where urethane rubber plate in 1.0 mm thick is bonded on the blade support plate 25.

In addition, the contacting pressure of the control blade 13 to the developing roller 11 is set to be 25 to 35 g/cm (linear load is measured by inserting three sheets of thin metal plate, whose coefficients of friction are known, into the contacting section and converting a value when one of them is drawn with a spring balance). As a contacting direction of the control blade 13 to the developing roller 11, an end section of the control blade 13 is located in the upstream in the rotational direction of the developing roller 11 in the contacting section with the developing roller 11, that is, in a counter direction.

The toner charging roller 19 consists of rubber roller, contacts to the contacting section of the control blade 13 with the developing roller 11 in the downstream in the rotational direction of the developing roller 11, and is rotatably supported. A toner charging bias supply 26 is connected to the toner charging roller 19, applies a toner charging bias in a predetermined electric potential and polarity from the toner charging bias supply 26 to the toner charging roller 19, and charges toner t, adhering to a surface of the developing roller 11, by discharge. In addition, the developing bias supply 23 and toner charging bias supply 26 that are connected respectively to the developing roller 11 and toner charging roller 19 are controlled by a controller (CPU) 27 connected.

The toner t is non-magnetic one-component developer, toner having an advantage of little abrasion of the photosensitive drum 1, that is, spherical and smoothly-surfaced toner is used because the toner, as described above, is superior in transcription and lubricity is high when waste toner, remaining on the photosensitive drum 1 without being transferred, is cleaned by the cleaning blade 5.

Concretely, a toner volume resistance value is $10^{14}$ Ω·cm or more, and measurement was performed with using a weight that has 6 mm in diameter, area of measuring electrode plate of 0.283 $cm^2$, and pressure of 1500 g. Other conditions were pressure of 980 $g/cm^2$ (96.1 kPa), and powder layer thickness of 0.5 to 1.0 mm. A current value was measured with a microammeter (YHP 4140pA METER/DC VOLTAGE SOUCE) in 400 V DC, and the volume resistance value was calculated from the measured current value.

In addition, toner having SF-1 of 100 to 180 and SF-2 of 100 to 140 as form factors of the toner t was used. Furthermore, these SF-1 and SF-2 were values obtained by sampling 100 toner images at random with using a Hitachi FE-SEM (S-800), introducing the image information into a Nicolay image analysis instrument (Luzex3) through an interface to perform analysis, and calculating the values with using the following formulas:

$$SF\text{-}1=(MXLNG)^2/((\mathrm{AREA}\times(\pi/4)\times 100) \quad (1)$$

$$SF\text{-}2=(PERI)^2/((\mathrm{AREA}\times(\pi/4)\times 100) \quad (2)$$

Here, AREA is a toner project area, MXLNG is absolute maximum length, and PERI is peripheral length.

This form factor of toner t, SF-1 shows a sphericity, and as it becomes larger than 100, a form gradually becomes indeterminate. In addition, SF-2 shows an unevenness, and as it become larger than 100, the irregularity of a toner surface becomes remarkable.

As production methods of toner t, in case the toner t becomes within a range of the above-described form factors (SF-1, SF-2), there is a production method, a so-called grinding method, and it is also possible to produce the toner with using a method of directly producing the toner with using a suspension polymerization method disclosed by Japanese Patent Application Laid-Open No. 36-10231 and Japanese Patent Application Laid-Open No. 59-53856, a dispersion polymerization method directly producing the toner with using aqueous organic solvent where monomer is soluble but polymer obtained is insoluble, or an emulsion polymerization method that is represented by a soap-free polymerization method producing the toner by performing direct polymerization with water-soluble polar polymerization initiator.

In this embodiment, using the suspension polymerization method at normal pressure or under pressure, which can easily control the form factors of the toner t so that SF-1 becomes 100 to 180 and SF-2 becomes 100 to 140 and can comparatively easily obtain fine grain toner of 4 to 8 μm since particle size distribution is sharp, colored suspension particles having weight average particle size 7 μm were produced by mixing styrene and n-butylacrylate as monomer, salicylic acid metallic compound as charge control agent, saturated polyester as a polar resin, and further coloring agent.

In addition, by further adding 1.5 wt % of hydrophobic silica to this, the toner t in negative polarity was produced, the toner t which is superior in the above-described transcription and generates little abrasion in the cleaning of the photosensitive drum 1.

Next, the developing operation of the developing apparatus 20 according to this embodiment will be described.

In developing operation, the toner t in developing container 10 is sent to the elastic roller 12 in connection with the rotation of the agitating member 14 in the direction shown by an arrow (clockwise). This toner t is conveyed to the vicinity of the developing roller 11 by the rotation of the elastic roller 12 in the direction shown by an arrow of (counterclockwise). Then, in a contacting section of the developing roller 11 and elastic roller 12, the toner t born on the elastic roller 12 is triboelectrifies by being rubbed with the developing roller 11, and hence adheres on the developing roller 11.

In addition, the toner t is sent under the pressure by the elasticity blade 13 in connection with the rotation of the developing roller 11 in the direction shown by an arrow (counterclockwise), and a thin layer of the toner t is formed on the developing roller 11. In this embodiment, it is set that good electrified charge of the toner t is −60 to −20 μC/g, good toner coating quantity is 0.4 to 1.0 $mg/cm^2$, and a toner layer thickness becomes 10 to 20 μm.

Furthermore, in order to keep the electrified charge of the toner t adhering onto the developing roller 11 high, the toner t is charged by discharge caused by the toner charging roller 19 contacting to all the image formation area formed on the developing roller 11. The toner charging roller 19 contacts to the developing roller 11 in the contacting load of 100 to 200 gF by a pressure member (not shown). Owing to the contact of the toner charging roller 19, the toner t is precisely filled up on the developing roller 11 to uniformly coat the developing roller 11. Moreover, as for the positional relationship between the control blade 13 and toner charging roller one 9 in the longitudinal direction, it is preferable that they are arranged so that the toner charging roller 19 can surely cover all the area of the control blade 13 on the developing roller 11.

Here, a method of charging the toner t on the developing roller 11 by the toner charging roller 19 will be described below.

Figure 3:
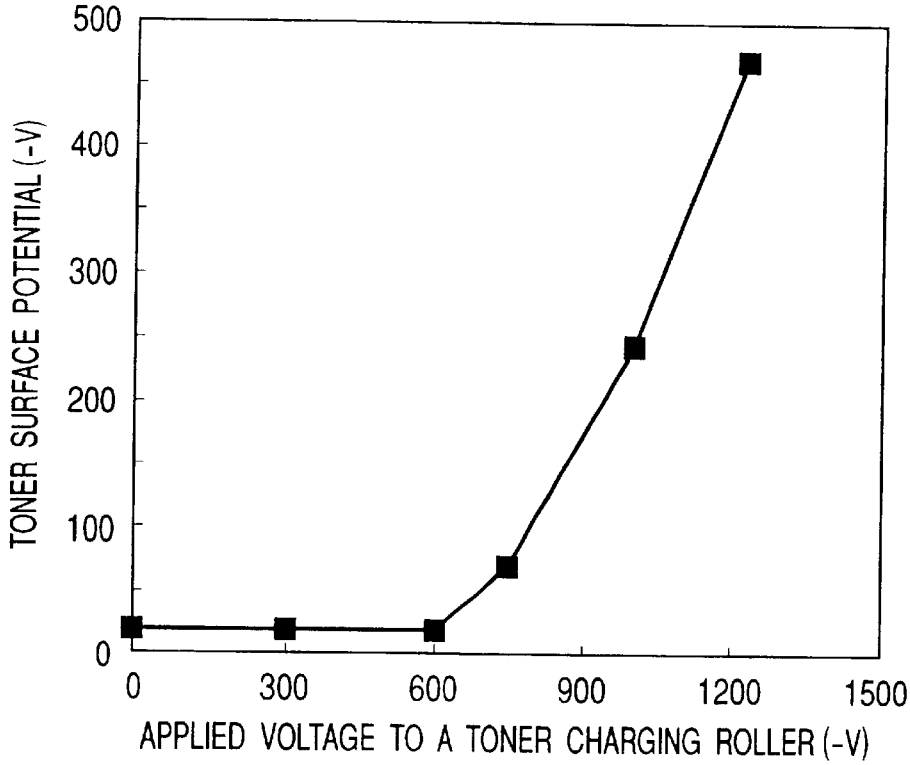
FIG. 3 is a graph showing the relation between the voltage applied to a toner charging roller and the toner surface potential.

According to the investigation of the relation between the voltage applied to the toner charging roller 19 and the surface potential of the toner t in the case where the resistance of the toner charging roller 19 was $10^8\Omega$, an experimental result as shown in FIG. 3 was obtained.

Figure 4:
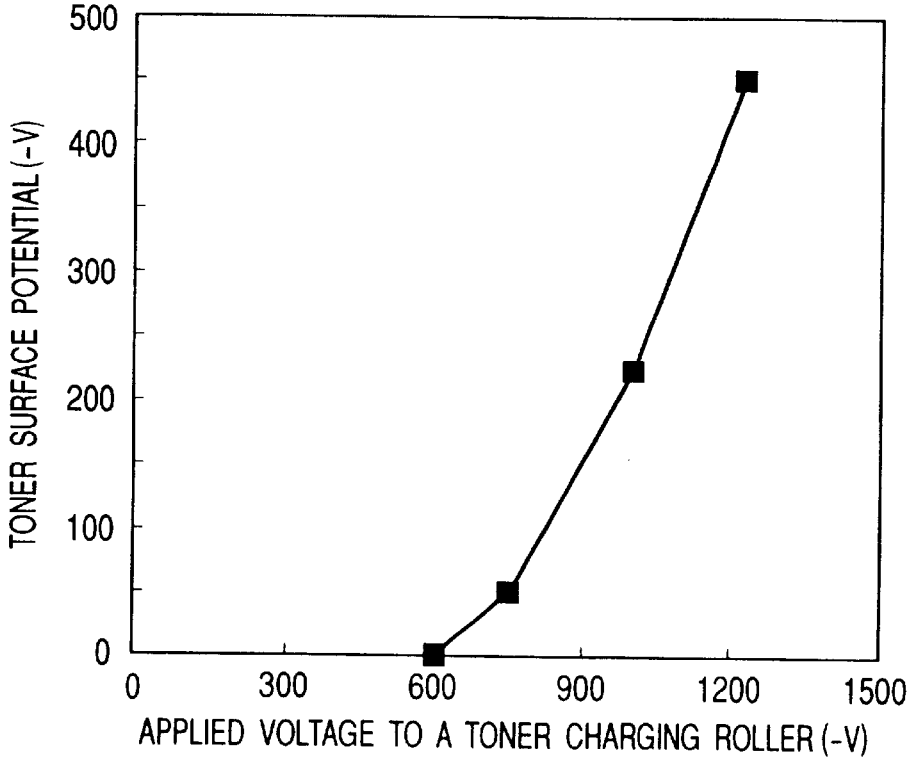
FIG. 4 is a graph showing the relation between the voltage applied to the toner charging roller and the toner surface potential in the case where the surface potential by triboelectrification is removed.

As apparent from this result, the surface potential of the toner t (toner surface potential) has nearly −20 V of surface potential even if the voltage applied from the toner charging bias supply 26 is 0 V. This is because the toner t is triboelectrified in the elastic roller 12 and control blade 13. Except the surface potential by this triboelectrification, as shown in FIG. 4, discharging start voltage with the toner t starts up from nearly −600 V, and this potential behaves similarly to the DC discharge and charge of the charging roller 2 to the photosensitive drum 1.

Discharging start voltage between the toner charging roller 19 and toner t is determined by an intersection of the following formulas (3) and (1):

$$Vb=312+6.2\ g \tag{3}$$

$$Vg=g(Va-Vc)/((Lt/Kt)+g) \tag{4}$$

where:

Vb: approximate equation of Paschen law in g>8 $\mu$m

Vg: voltage of air gap between toner charging roller 19 and surface of toner layer Va: voltage applied to toner charging roller 19

Vc: surface potential of toner layer g: length of air gap between toner charging roller 19 and surface of toner layer Lt: thickness of toner layer Kt: dielectric constant of toner layer.

Figure 5:
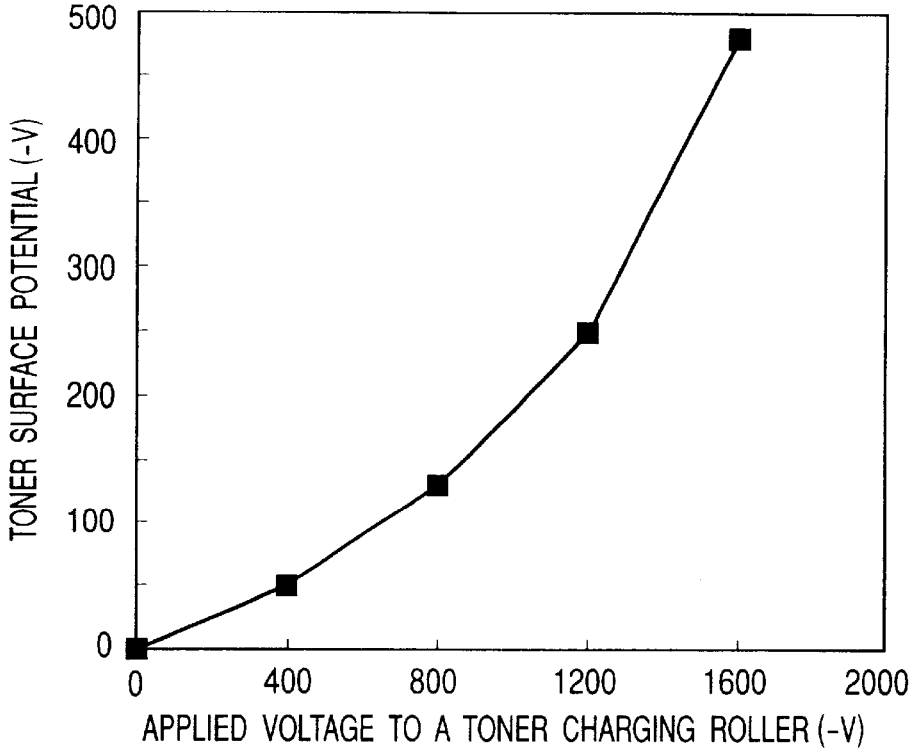
FIG. 5 is a graph showing the relation between the voltage applied to a toner charging roller and the toner surface potential in the case where injection electrification is performed.

Because a rate of toner t and air in the toner layer is constant since the toner t used in this embodiment is superior in particle size distribution and its shape is spherical, Kt in the above-described formula (4) is stable, and hence charging by stable discharge is performed. As for the charging of toner, there is injection electrification as another method. In this case, the voltage applied to the toner charging roller 19 and the surface potential of the toner t behave as shown in FIG. 5. From the above-described result, it is conceivable that the charging method in this embodiment uses discharge.

The experiment shown in FIGS. 3 and 4 is a case where an entire area in the longitudinal direction of the toner charging roller 19 contacts to a section that is coated with the toner t. If a resistance range of the toner charging roller 19 where toner discharge is possible is equal to or less than $10^7\omega$, it is not possible to obtain a voltage between the toner charging roller 19 and the section coated with the toner t with which toner discharge is possible. If $10^{12}\Omega$ or more, in such configuration of this embodiment, discharging start voltage is too large, and hence this is not suitable.

Therefore, an appropriate range of resistance of the toner charging roller 19 is $10^8$ to $10^{11}\Omega$, and in this embodiment, if the developing roller 11 having the resistance of $10^4$ to $10^6\Omega$ is used, the resistance of the toner charging roller 19 is fit to the above-described appropriate range.

Here, in the measurement of a resistance value of the toner charging roller 19, with contacting the toner charging roller 19 to a metal roller, which is made of aluminum and is 16 mm in diameter and 210 mm long in its longitudinal direction, in the contacting load of 170 gF, the metal roller is rotated in predetermined peripheral speed (e.g., 80 mm/sec). Then, −400 V DC is applied to the toner charging roller 19, and a resistor of 10 K$\Omega$ is arranged in the ground side. In addition, the resistance of the toner charging roller 19 is calculated by measuring a voltage between both ends of this resistor, and calculating a current value from the measured voltage values.

Figure 6:
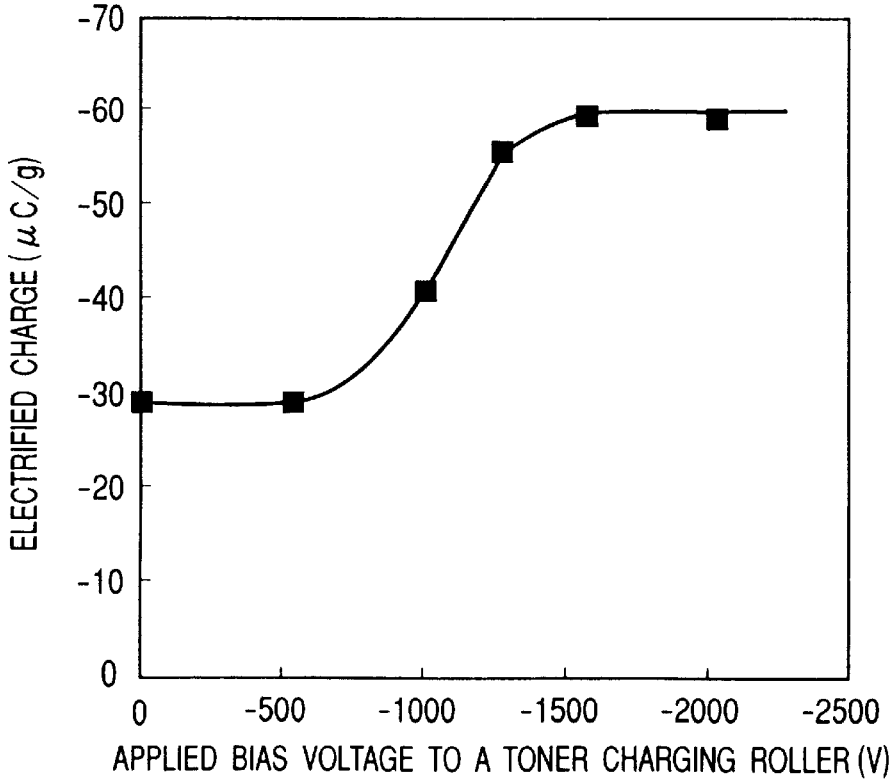
FIG. 6 is a graph showing the relation between the voltage applied to the toner charging roller and the electrified charge.

In addition, according to the experiment of the present inventor, the electrified charge of the toner t for the voltage between the toner charging roller 19 and toner t on the developing roller 11, as shown in FIG. 6, is saturated from nearly 1200 V. In this embodiment, in order to perform stable discharge, it is set that a voltage between the developing roller 11 and toner charging roller 19 becomes 1500 V. Owing to this, when a bias applied from the developing bias supply 23 to the developing roller 11 is set to be −300 V, a bias applied from the toner charging bias supply 26 to the toner charging roller 19 is set to be −1800 V.

In addition, the toner t that is charged and formed on the developing roller 11 in a thin layer is conveyed to a developing section with contacting to and facing the photosensitive drum 1. In this developing section, the toner t laminated on the developing roller 11 adheres to an electro static latent image formed on the photosensitive drum 1 by the developing roller 11 where a developing bias in the same polarity as a charged polarity (negative polarity) of the photosensitive drum 1 is applied, and is developed as a toner image.

Furthermore, toner which does not contribute to the developing on the developing roller 11 is scraped off from a surface of the developing roller 11 in the contacting section to the elastic roller 12. A large portion of this toner scraped off is conveyed in connection with the rotation of the elastic roller 12, and is mixed with the toner t in the developing container 10. Hence, electrified charges of the toner are dispersed. Moreover, at the same time, new toner is supplied on the developing roller 11 by the rotation of the elastic roller 12, and above-described developing operation is repeated.

In this manner, in the above-described developing apparatus 20 in this embodiment, it is possible to keep electrified charge of the toner t high because charging by the toner charging roller 19 is performed after the toner t passes the control blade 13 by such configuration that the toner charging roller 19 is provided with contacting to the developing roller 11.

Next, the cleaning of toner adhering to the toner charging roller 19 by the above-described developing operation will be described.

Figure 7:
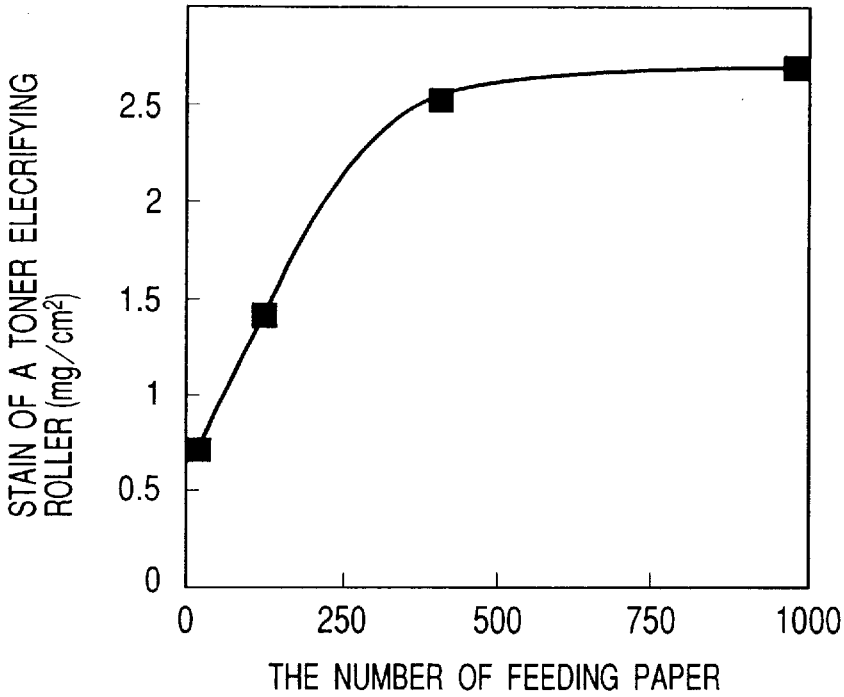
FIG. 7 is a graph showing the relation between the number of feeding paper and the stain of a toner charging roller in a conventional example.

As shown in FIG. 7, if the cleaning of the toner charging roller 19 is not performed in a two-sheet intermittent mode, contamination toner adheres to the toner charging roller 19 during developing operation, and hence, as the sheets of passing paper increases, the stain on the surface of the toner charging roller 19 increases.

Figure 8:
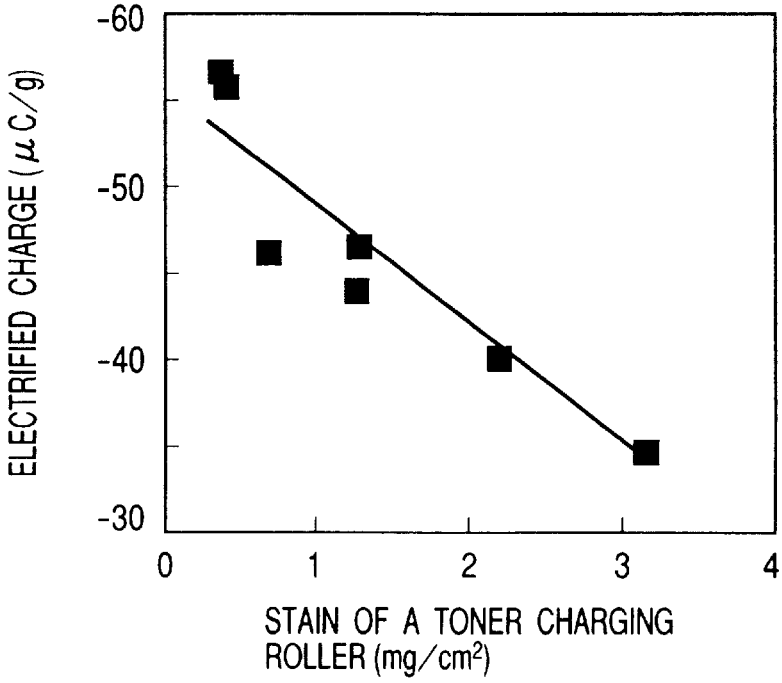
FIG. 8 is a graph showing the relation between the stain of the toner charging roller and the electrified charge.

If the stain of the surface of the toner charging roller 19 increases, as shown in FIG. 8, charging capability (electrified charge) to the toner on the developing roller 11 by the toner charging roller 19 deteriorates. The contamination toner on the toner charging roller 19 that adheres during the developing operation adheres by a force of an electrical field. For this reason, it is possible to reduce the contamination toner by cleaning the toner charging roller 19 through changing electric field intensity.

Figure 9:
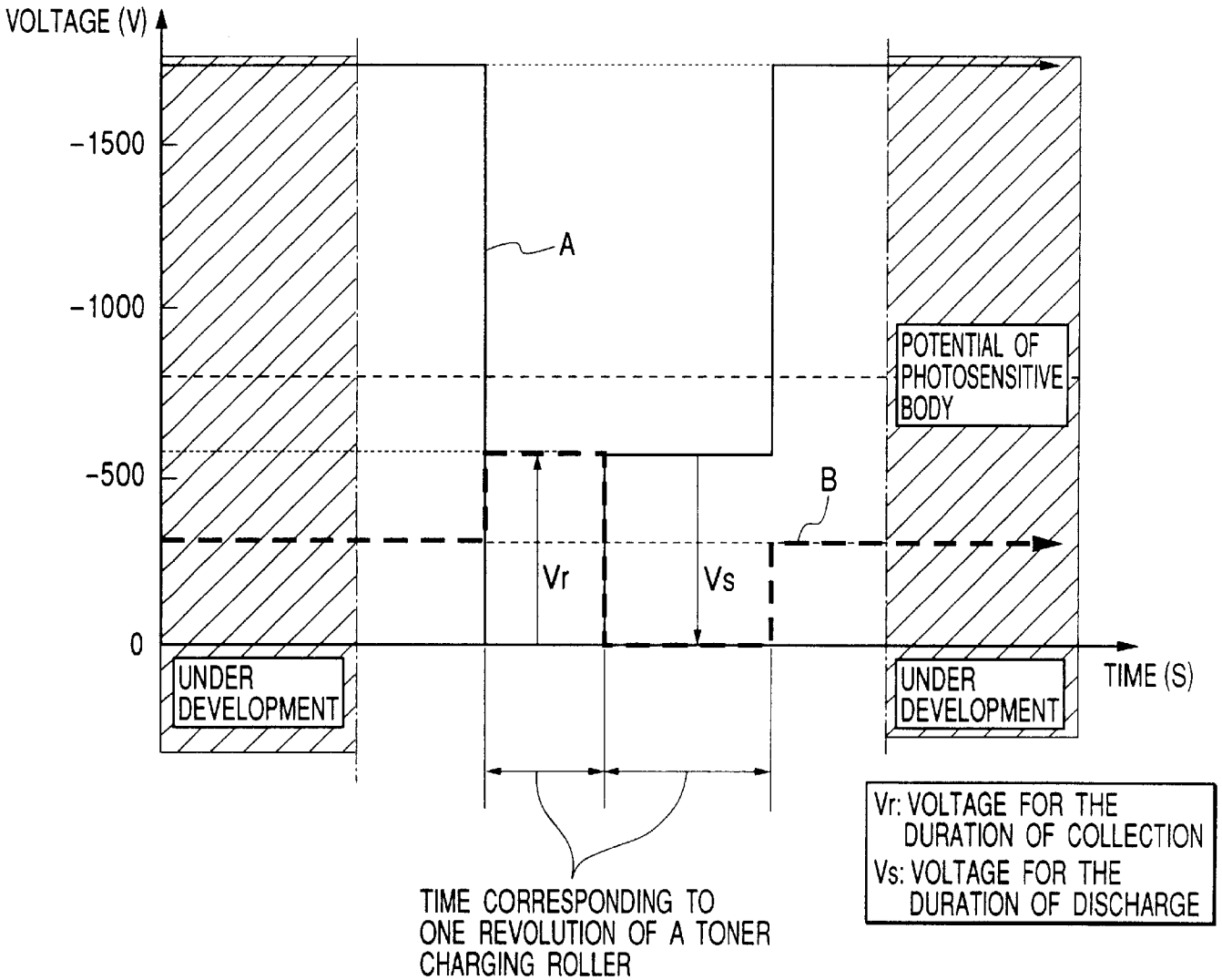
FIG. 9 is a graph showing the relation between the developing roller and the voltage applied to the toner charging roller in cleaning operation of the toner charging roller in the first embodiment.
Figure 10:
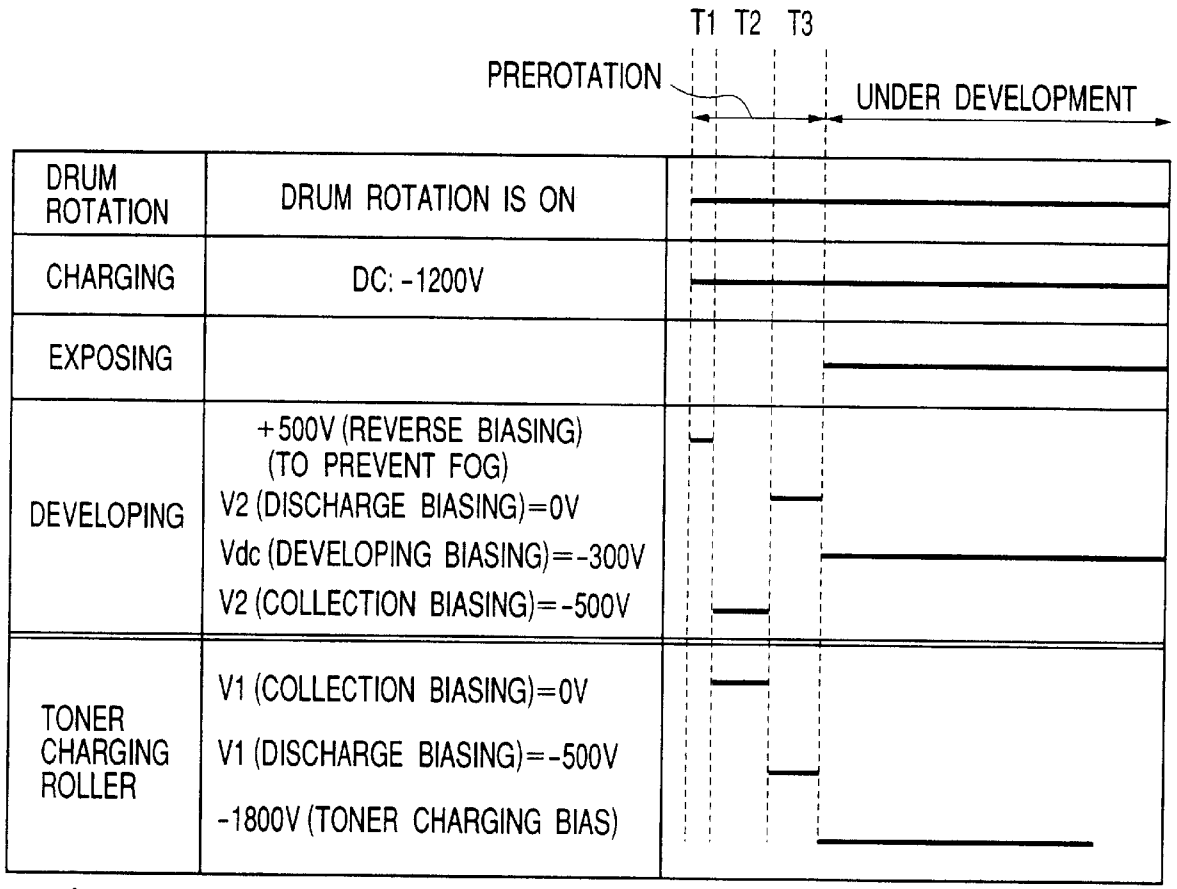
FIG. 10 is a cleaning sequence chart of the toner charging roller in the first embodiment.

Here, FIG. 9 is a graph showing the relation between the developing roller, used as cleaning means of the toner charging roller 19, and the voltage applied to the toner charging roller 19, and FIG. 10 is a cleaning sequence chart of the toner charging roller 19.

As shown in FIGS. 9 and 10, the cleaning of the toner charging roller 19 starts just after the rotation of the photosensitive drum 1 starts, and finishes just before a developing potential to develop an electro static latent image on the photosensitive drum 1 by the toner starts. The sequence in this period is to make the toner charging roller 19 collect the toner on the developing roller 11 electrostatically for a while by changing a voltage between the toner charging roller 19 and developing roller 11, and after that, to discharge on the developing roller 11 the toner adhering on the toner charging roller 19 with the contamination toner on the toner charging roller 19.

Such operation that the voltage between the toner charging roller 19 and developing roller 11 is changed is performed by the controller (CPU) 27 controlling the developing bias supply 23 shown in FIG. 2 and the toner charging bias supply 26.

In this embodiment, negative toner is used as the toner. As shown in FIG. 9, a voltage between the toner charging roller bias, applied to the toner charging roller 19, and the developing roller bias applied to the developing roller 11 indicates a positive polarity in a voltage Vr (voltage for the duration of collection) in the case of collecting the toner on the developing roller 5 in the toner charging roller 19, and indicates a negative polarity in a next voltage Vs (voltage for the duration of discharge) discharging the toner on the toner charging roller 19 to the developing roller 11. In FIG. 9, reference character A denotes a toner charging bias for the toner charging roller 19, and B denotes a developing roller bias for the developing roller 11.

In addition, Vr and Vs are made to be kept while the toner charging roller 19 rotates one or more turns. In this embodiment, the duration of the voltage for the duration of collection, Vr is made to be 0.5 sec, and the duration of the voltage for the duration of discharge, Vs is made to be 1.2 sec. In addition, in order to suppress toner consumption and to prevent toner contamination to the photosensitive drum 1 while the above-described cleaning sequence is performed, the surface potential of the photosensitive drum 1 is made to be −800 V to keep the electric potential in which the toner is not developed.

Here, the cleaning sequence shown in FIG. 9 will be briefly described.

In this embodiment, the photosensitive drum 1 is rotationally driven since prerotation before image forming operation (developing operation), and the charging roller 2 receives the charging bias of −1200 V to charge the photosensitive drum 1. After the completion of the prerotation, since the surface of the photosensitive drum 1 is exposed according to image information, an electro static latent image is formed.

Furthermore, at time T1 (distance between charging roller 2 and developing roller 11 on surface of photosensitive drum 1/process speed of photosensitive drum 1) in the prerotation, a reverse bias for fog prevention (in this embodiment, +500 V) is applied to the developing roller 11. Moreover, at time T2 (time which toner charging roller 19 rotates one turn or more), a collection bias V2 (in this embodiment, −500 V) for making the toner charging roller 19 collect the toner on the developing roller 5 is applied to the developing roller 11. After that, at time T3 (time which toner charging roller 19 rotates one turn or more), a discharge bias V2 (in this embodiment, 0 V) for making the developing roller 11 discharge the toner on the toner charging roller 19 is applied to the developing roller 11. In addition, in developing operation after the completion of the prerotation, a developing bias Vdc of −300 V is applied to the developing roller 11.

On the other hand, at the time T1 in the prerotation, a collection bias V1 (in this embodiment, 0 V) for making the toner charging roller 19 collect the toner on the developing roller 11 is applied to the toner charging roller 19. After that, at the time T3, a discharge bias V1 (in this embodiment, −500 V) for making the developing roller 11 discharge the toner on the toner charging roller 19 is applied to the toner charging roller 19. In addition, in developing operation after the completion of the prerotation, a toner charging bias of −1800 V is applied to the toner charging roller 19.

Figure 11:
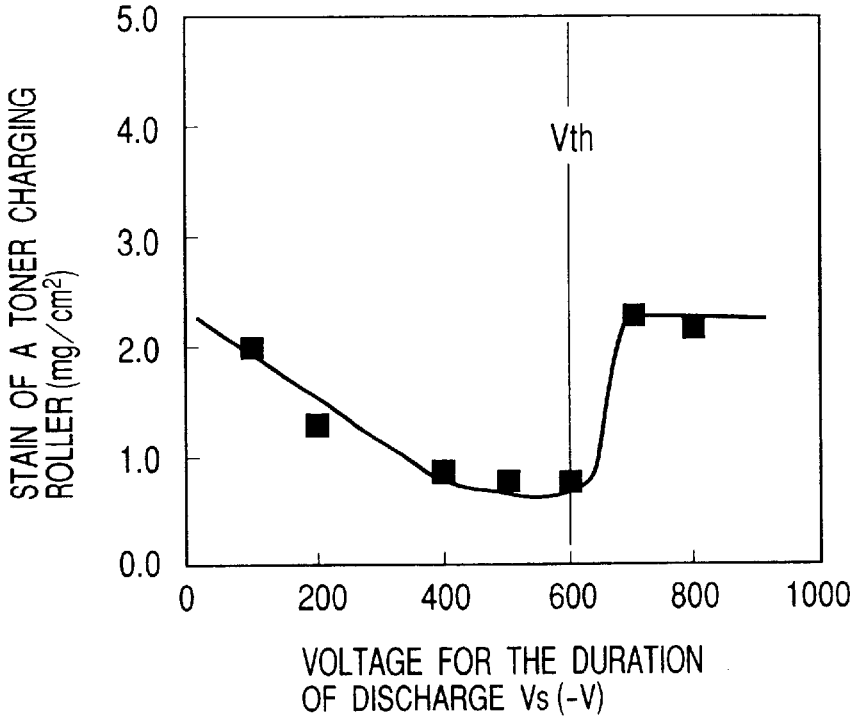
FIG. 11 is a graph showing the relation between the voltage for the duration of discharge and the stain of the toner-charging roller.

FIG. 11 is a graph showing the relationship of the voltage for the duration of discharge, (Vs) and the stain of the toner charging roller 19 in the case of the above-described cleaning operation of the toner charging roller 19. At this time, the voltage for the duration of collection (Vr) was fixed at −500 V, the stain on the toner charging roller 19 is set to be 2.5 ($mg/cm^2$) beforehand, and the cleaning sequence described above was performed.

As shown in FIG. 11, although the stain on the toner charging roller 19 decreases as |Vs| increases, the discharge property of contamination toner deteriorates with the discharging start voltage (Vth) between the toner charging roller 19 and developing roller 11 as a boundary. This is because the discharge of the toner is performed out of a discharge area, and further because the discharge area becomes narrow by discharge being generated.

From above results, it is desirable to make the voltage for the duration of discharge (Vs) be (Vth−100 (V)) to Vth. In this embodiment, by setting the voltage for the duration of discharge (Vs) to be −500 V, it was possible to reduce the stain on the toner charging roller 19 from 2.5 ($mg/cm^2$) to 0.8 ($mg/cm^2$).

Figure 12:
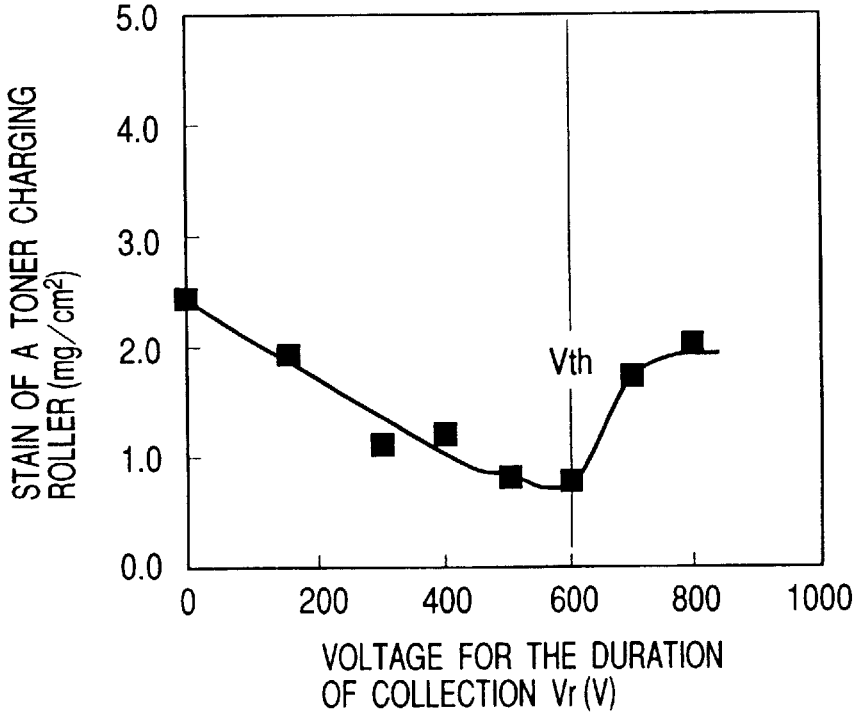
FIG. 12 is a graph showing the relation between the voltage for the duration of collection and the stain of the toner-charging roller.

FIG. 12 is a graph showing the relationship of the voltage for the duration of collection, (Vr) and the stain of the toner charging roller 19 in the case of the above-described cleaning operation of the toner charging roller 19.

At this time, the voltage for the duration of collection, Vs was set at −50 V, stain on the toner charging roller 19 was set to be 2.5 ($mg/cm^2$) beforehand, and the cleaning sequence described above was performed.

As shown in FIG. 12, the stain on the toner charging roller 19 after the cleaning sequence decreases in connection with the increase of the voltage for the duration of collection, Vr. This is because there is much toner making the contamination toner, adhering on the toner charging roller 19 before the voltage for the duration of collection is applied, transfer together on the developing roller 11 at the time of the application of the voltage for the duration of discharge.

However, similarly to the case of the voltage for the duration of discharge, Vs, if the voltage for the duration of collection, Vr exceeds the discharging start voltage Vth, an area for collecting toner on the developing roller 11 becomes narrow. Hence, at the time of application of the voltage for the duration of discharge, the toner being transferred together on the developing roller 11 decreases. As a result, the discharge quantity of the contamination toner on the toner charging roller 19 deteriorates.

For this reason, since it is desirable that toner collection quantity is as much as possible, it is desirable to make the voltage for the duration of collection, Vr be (Vth−100 (V)) to Vth. In this embodiment, the voltage for the duration of collection, Vr was set at 500 V.

In the present embodiment like this, after setting the voltage for the duration of collection, Vr at 500 V, and the voltage for the duration of discharge, Vs at −500 V, the above-described cleaning sequence was performed.

Figure 13:
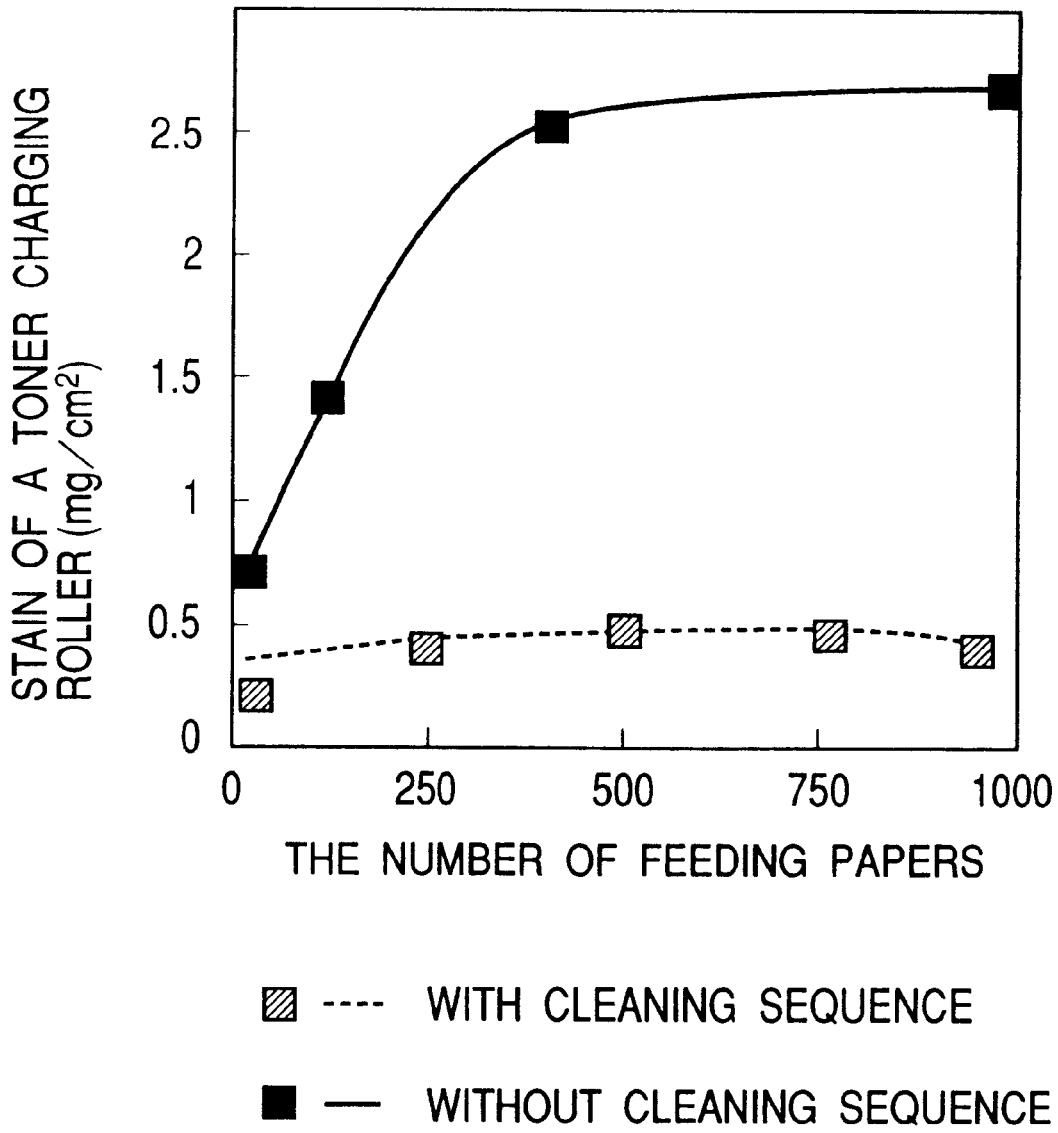
FIG. 13 is a graph showing the relation between the number of feeding paper and the stain of a toner charging roller in the first embodiment.

In consequence, as shown in FIG. 13, if the cleaning of the toner charging roller 19 is not performed in the two-sheet intermittent mode (solid line in the figure), the contamination toner adheres to the toner charging roller 19 in the developing operation. Hence, as the sheets of passing paper increases, the stain of the toner charging roller 19 increases. On the other hand, if the above-described cleaning sequence was performed (broken line in the figure), it was possible to keep the stain on the toner charging roller 19 little, that is, nearly 0.4 (mg/cm$^2$) even if the sheets of passing paper increased. Hence, since charges could be stably supplied to the toner on the developing roller 11, it was possible to always obtain good images.

In this manner, in this embodiment, regarding the voltage (V1–V2) between the voltage V1 applied to the toner charging roller 19 and the voltage V2 applied to the developing roller 11 at the non-developing time, particularly at the prerotation of the photosensitive drum 1 before the image forming operation (developing operation), by applying a voltage in the same polarity as that of the toner after applying a voltage in a polarity reverse to that of the toner, it becomes possible to remove the toner adhering to the toner charging roller 19 during image formation (developing operation). In addition, by making absolute values of the voltage for the duration of collection, Vr, and the voltage for the duration of discharge, Vs smaller than the discharging start voltage Vth, cleaning becomes possible in a broad area, and hence cleaning performance of the toner charging roller 19 is improved.

In consequence, as shown in FIG. 13, the toner charging roller 19 was always in a condition of little contamination toner during the image formation (developing operation). Therefore, it was possible to stably charge the toner on the developing roller 11, and hence it was possible to obtain good images.

Second Embodiment

Also, this embodiment will be described using an image forming apparatus including the developing apparatus according to the first embodiment shown in FIGS. 1 and 2.

The first embodiment has the configuration of performing the cleaning operation of a toner charging roller in the prerotation of a photosensitive drum before image forming operation (developing operation). However, in this embodiment, the cleaning operation of a toner charging roller described above is performed before and after the image forming operation (developing operation). Other configuration and developing operation are similar to those in the first embodiment, and hence their description will be omitted in this embodiment.

Figure 14:
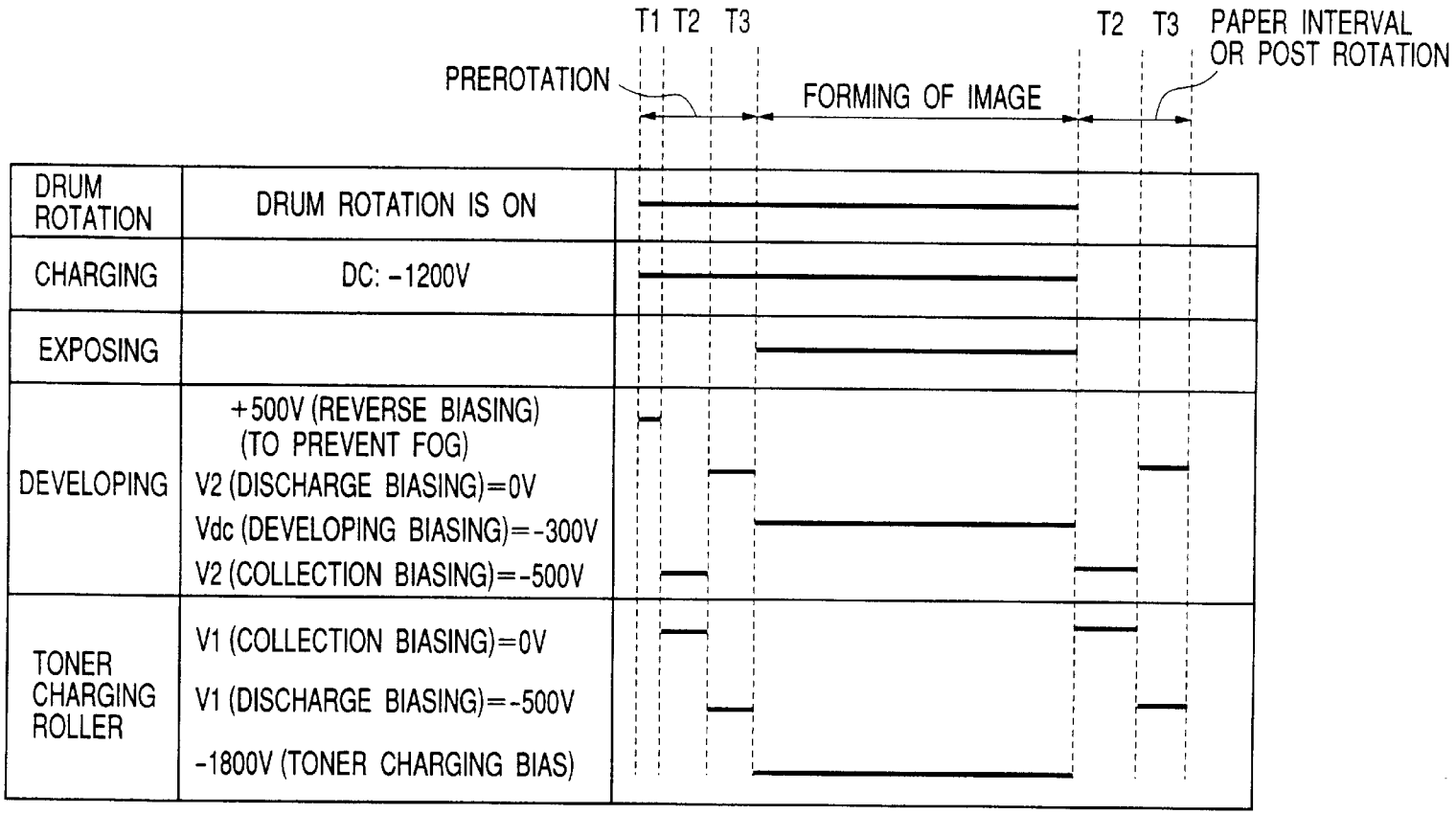
FIG. 14 is a cleaning sequence chart of the toner charging roller in a second embodiment.

In this embodiment, as shown in FIG. 14, in the prerotation of a photosensitive drum before image forming operation (developing operation) in the formation of one image, and in an paper interval after image formation operation (developing operation) or the postrotation of the photosensitive drum, the above-described cleaning operation of the toner charging roller is performed. A cleaning sequence chart of the toner charging roller that is performed in the prerotation of the photosensitive drum before image forming operation (developing operation) in this embodiment and in an paper interval after image formation operation (developing operation) or the postrotation of the photosensitive drum is similar to that of the first embodiment shown in FIG. 10. Hence, their description will be omitted in this embodiment. In addition, if an image forming signal (developing operation signal) is inputted in the postrotation of the photosensitive drum, it is made that the developing operation is performed after the cleaning of the toner charging roller is completed.

Also, in this embodiment, similarly to the first embodiment, after setting the voltage for the duration of collection at 500 V, and the voltage for the duration of discharge at −500 V, the above-described cleaning sequence was performed.

Figure 15:
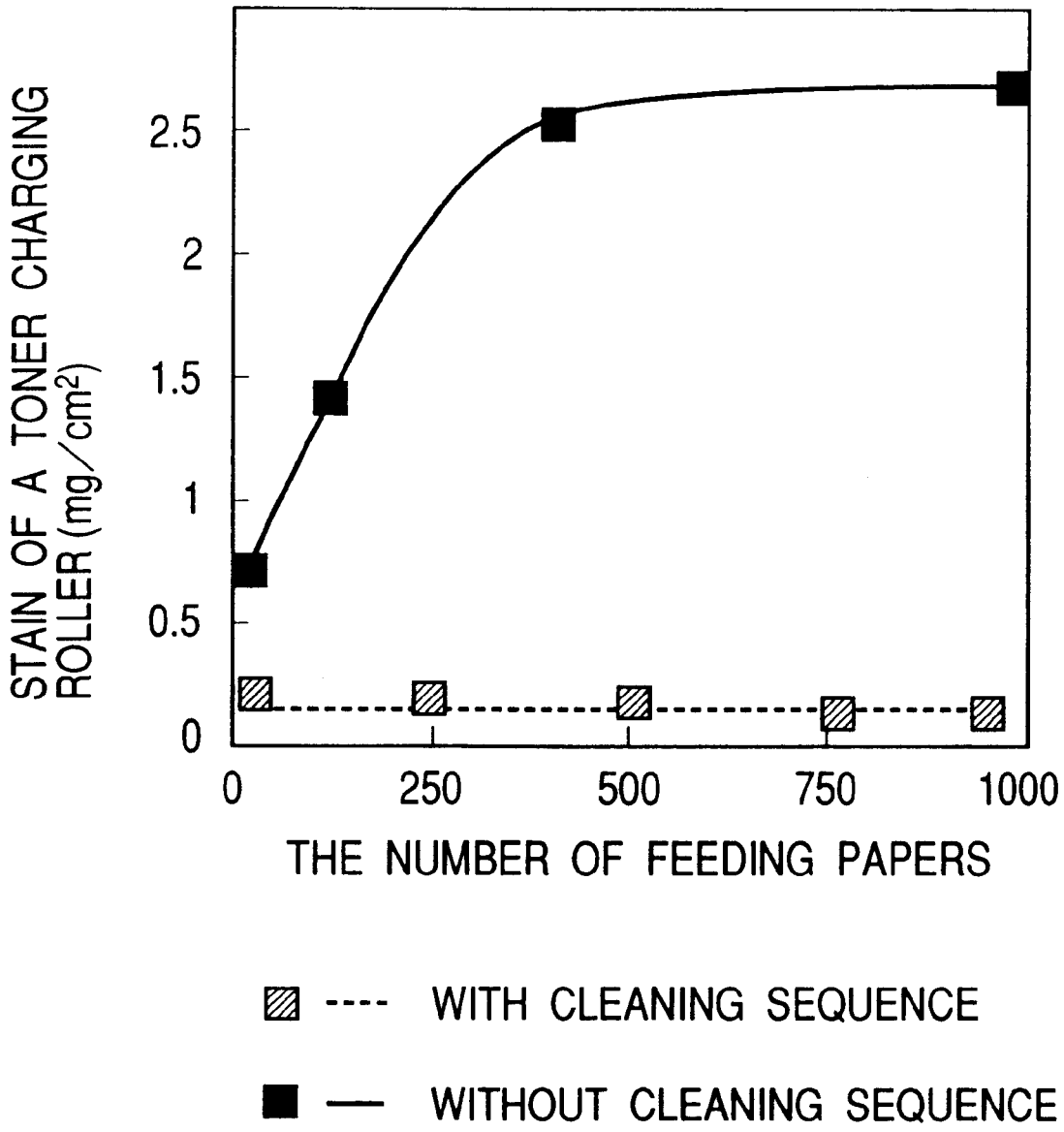
FIG. 15 is a graph showing the relation between the number of feeding paper and the stain of the toner charging roller in the second embodiment.

In consequence, as shown in FIG. 15, if the cleaning of the toner charging roller is not performed in the two-sheet intermittent mode (solid line in the figure), the contamination toner adheres to the toner charging roller in the developing operation. Hence, as the sheets of passing paper increases, the stain of a surface of the toner charging roller increases. On the other hand, if the above-described cleaning sequence was performed (broken line in the figure), it was possible to keep the stain on the toner charging roller 19 little, that is, nearly 0.2 (mg/cm$^2$) even if the sheets of passing paper increased. Hence, since charges could be stably supplied to the toner on the developing roller 11, it was possible to always obtain good images.

In this manner, this embodiment becomes more stable than the first embodiment by performing the cleaning operation of the toner charging roller before and after the image forming operation (developing operation), and it becomes possible to remove the toner adhering to the toner charging roller and to charge the toner on the developing roller 11. Hence, it is possible to obtain stable images.

Third Embodiment

In the first embodiment, in order to prevent toner contamination to the photosensitive drum during the cleaning operation of the toner charging roller, the surface potential of the photosensitive drum is made to be such a potential that the toner is not developed. In this embodiment, in order to prevent toner contamination to the photosensitive drum during the cleaning operation of the toner charging roller, it is made that the above-described cleaning operation is performed with making the developing roller and photosensitive drum apart from each other. Other configuration and developing operation are similar to those in the first embodiment, and hence their description will be omitted in this embodiment.

Figure 18:
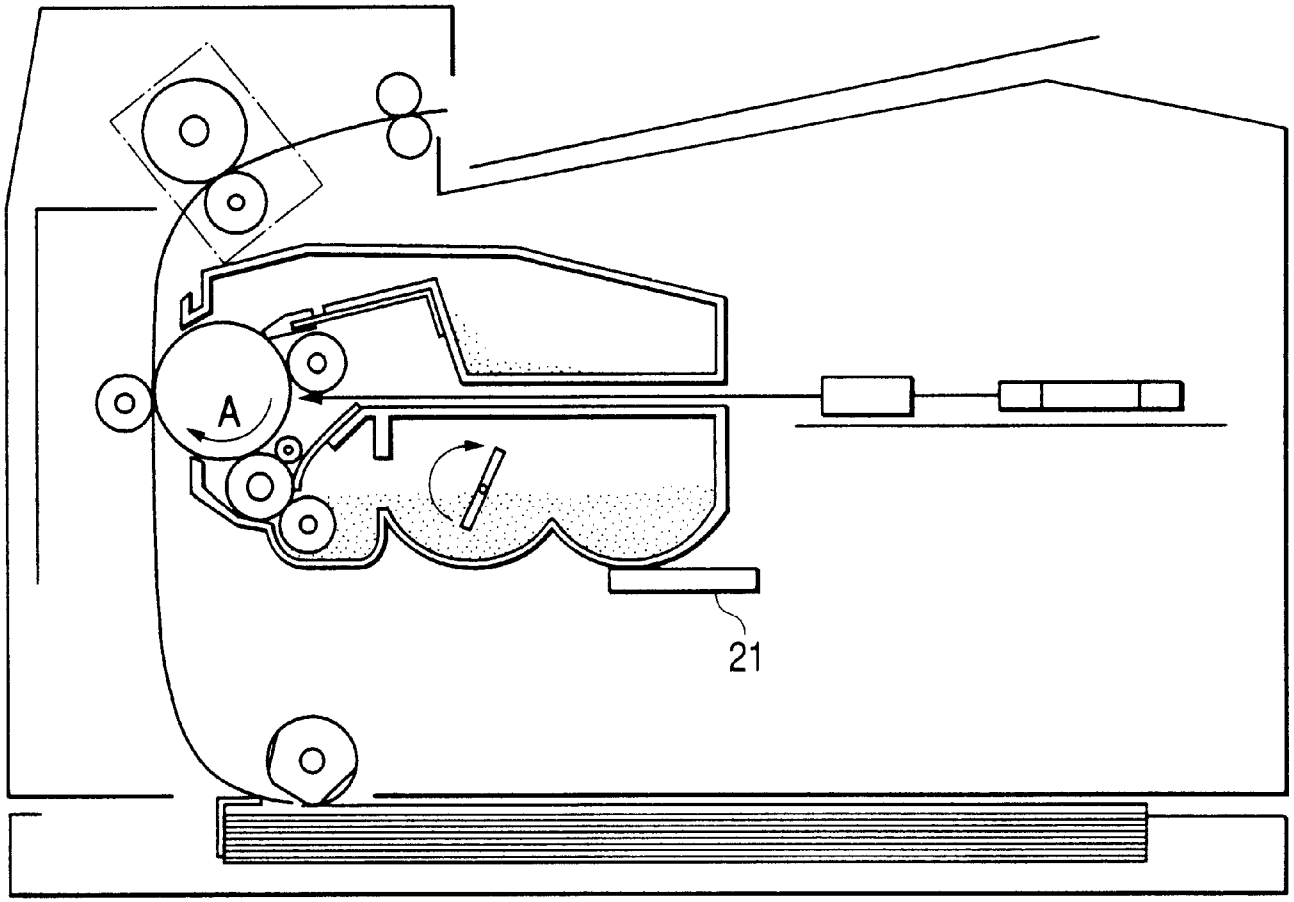
FIG. 18 is an image forming apparatus according to a third embodiment.
Figure 19A:
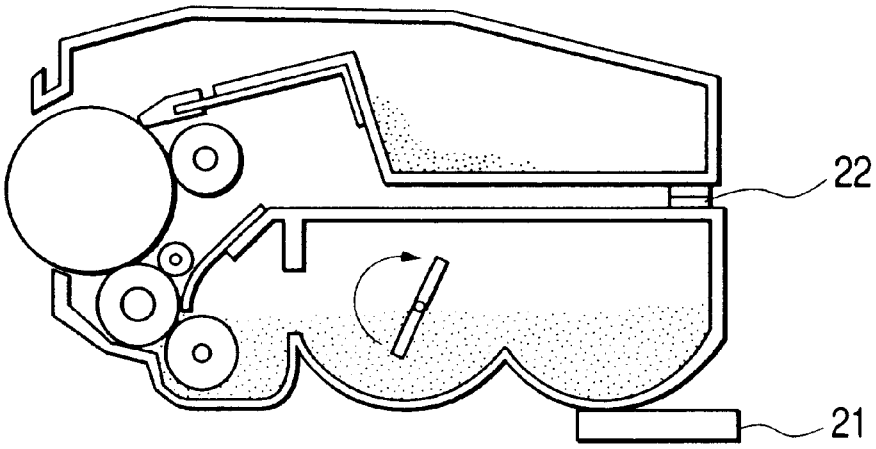
FIG. 19A is a schematic diagram showing a state in developing operation.
Figure 19B:
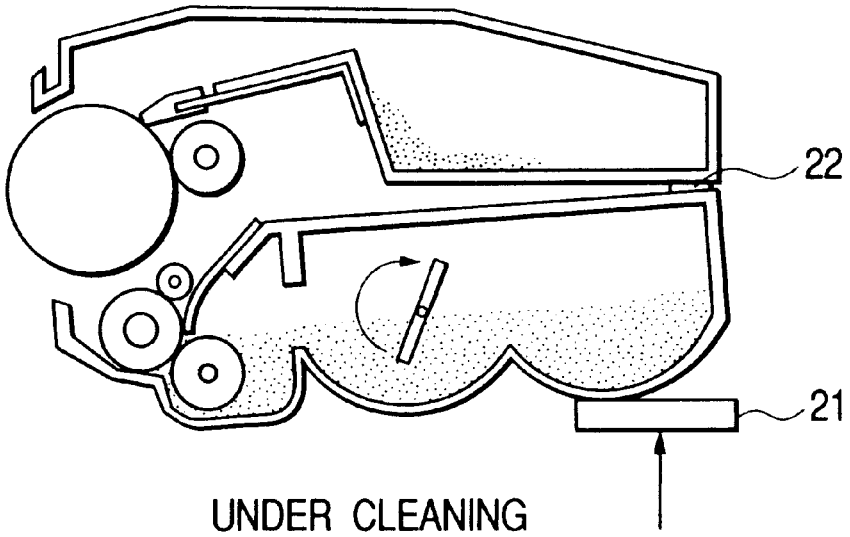
FIG. 19B is a schematic diagram showing the operation of making a developing roller apart from a photosensitive drum.

FIGS. 18, 19A and 19B show an image forming apparatus and a developing apparatus in this embodiment. The image forming apparatus in this embodiment, as shown in FIG. 18, has a separating plate 21 as separating means for keeping a space between the developing roller and photosensitive drum constant. The separating plate 21 makes the developing roller and photosensitive drum separated from or contact to each other by being made to go up and down by driving means not shown. FIG. 19A shows states of the developing apparatus and cleaning container in the image forming operation (developing operation), the separating plate is in its predetermined position, and the developing roller and photosensitive drum contact to each other. If the cleaning operation described above is performed except the image forming operation (developing operation), just before the cleaning operation, as shown by an arrow in FIG. 19B, by moving the separating plate upward by the driving means not shown and hence lifting a lower part of the developing apparatus, the developing roller and a photosensitive drum are made to be separated. Thereafter, the above-described cleaning operation is performed, and furthermore, when a next image forming signal (developing signal) is inputted, the developing roller and photosensitive drum are made to contact to each other again by moving the separating plate downward just before the developing operation. In addition, there is a spring 22 between the developing apparatus and cleaning container, and these components are configured so that a force acts in such a direction that the developing roller and photosensitive drum contact to each other when the separating plate is moved downward.

Also, in this embodiment, similarly to the first embodiment, after setting the voltage for the duration of collection at 500 V, and the voltage for the duration of discharge at −500 V, the above-described cleaning sequence was performed. In consequence, it was possible to keep stain adhering to the toner charging roller little and to stably charge the toner on the developing roller, and hence it was possible to always obtain good images.

Furthermore, in this embodiment, in the cleaning operation of the toner charging roller, by making the developing roller and photosensitive drum apart from each other using the separating means, it was possible to prevent the toner contamination to the photosensitive drum.

In addition, although negative toner is used as toner in each embodiment described above, it is possible to similarly apply the present invention if positive toner is used. Furthermore, in this case, it goes without saying that the voltage for the duration of collection Vr is made to be in a negative polarity and the voltage for the duration of discharge Vs is made to be in a positive polarity.

Moreover, each embodiment described above has such configuration that the process cartridge 21 having the developing apparatus 20 and photosensitive drum 1 is detachably loaded into the body of the image forming apparatus, 22. Nevertheless besides this, for example, it is also good to use an assembly, which is configured by forming the developing apparatus 20 and photosensitive drum 1, charging roller (charging apparatus) 2, cleaning blade 5, and cleaning container 18 in one piece, as a process cartridge detachable from the body of the image forming apparatus. In addition, it is also good to have such configuration that the developing apparatus 20 is fixed in the body of the image forming apparatus.

Furthermore, in each embodiment described above, although the image forming apparatus includes the developing apparatus forming a monochrome toner image, it is possible to similarly apply the present invention to a color image forming apparatus having a plurality of above-described developing apparatuses which each contain each color toner.

As described above, according to this embodiment, it is possible to obtain good images because stable charges can be always given to developer born on a surface of a developer bearing body by reducing deposit of developer adhering to a surface of a developer charging member.

What is claimed is:

1. A developing apparatus, comprising:

a developer bearing body for bearing a developer and conveying the developer to a developing section; and a developer charging member for charging the developer borne by the developer bearing body, the developer charging member being provided at an upstream side of the developing section in a conveying direction of the developer borne by the developer bearing body and being cleaned in a nondeveloping operation period;

a first power source for applying a developing voltage to the developer bearing body;

a second power source for applying a developer charging voltage to the developer charging member; and control means for controlling the first power source and the second power source, wherein the developer borne by the developer bearing body is charged by applying a developer charging voltage with a same polarity as a polarity of the developing voltage from the second power source to the developing charging member, and wherein, in the nondeveloping operation period, the control means causes the first power source to apply a first voltage to the developer bearing body, causes the second power source to apply a second voltage to the developer charging member, charges a polarity of a voltage difference between the first voltage and the second voltage opposite to a charging polarity of the developer, and recharges a polarity of the voltage difference as a charging polarity of the developer.

2. The developing apparatus according to claim 1, wherein a developer image is formed by applying a developing voltage to the developer bearing body from the first power source and causing the developer, which is charged, to adhere to an electrostatic latent image formed on an image bearing body in the developing section.

3. The developing apparatus according to claim 1, wherein the nondeveloping operation period includes at least one of a prerotation operation period of an image bearing body before a developing operation a postrotational operation period of the image bearing body after the developing operation, and an interval until a start of a next developing operation.

4. The developing apparatus according to claim 1, wherein the developer is a nonmagnetic one-component developer.

5. A developing apparatus, comprising:

a developer bearing body for bearing developer and conveying the developer to a developing section;

a developer charging member for charging the developer borne by the developer bearing body, the developer charging member being provided at an upstream side of the developing section in a conveying direction of the developer borne by the developer bearing body and being cleaned in a nondeveloping period;

a first power source for applying a developing voltage to the developer bearing body; and a second power source for applying a developer charging voltage to the developer charging member;

wherein the developer borne by the developer bearing body is charged by applying a developer charging voltage with a same polarity as a polarity of the developing voltage from the second power source to the developer charging member, and wherein the second voltage applied from the second power source to the developer charging member in the nondeveloping operation period time is lower than a discharging start voltage for the developer borne by the developer bearing body.

6. A developing apparatus, comprising:

a developer bearing body for bearing a developer and conveying the developer to a developing section;

a developer charging member for charging the developer borne by the developer bearing body, the developer charging member being provided at an upstream side of the developing section in a conveying direction of the developer borne by the developer bearing body and being cleaned in a nondeveloping period;

a first power source for applying a developing voltage to the developer bearing body; and a second power source for applying a developer charging voltage to the developer charging member, wherein the developer borne by the developer bearing body is charged by applying a developer charging voltage with a same polarity as a polarity of the developing voltage from the second power source to the developer charging member, and wherein the nondeveloping operation period corresponds to prerotational operation period of an image bearing body before a developing operation.

7. An image forming apparatus, comprising:

an image bearing body for bearing a latent image; and a developing apparatus for developing the latent image, the developing apparatus including:

a developer bearing body for bearing developer and conveying the developer to a developing section;

a developer charging member for charging the developer borne by the developer bearing body, the developer charging member being provided at an upstream side of the developing section in a conveying direction of the developer borne by the developer bearing body and being cleaned in a nondeveloping operation period, a first power source for applying a developing voltage to the developer bearing body;

a second power source for applying a developer charging voltage to the developer charging member;

control means for controlling the first power source and the second power source, wherein the developer borne by the developer bearing body is charged by applying a developer charging voltage with a same polarity as a polarity of the developing voltage from the second power source to the developer charging member, and wherein, in the nondeveloping operation period, the control means causes the first power source to apply a first voltage to the developer bearing body, causes the second power source to apply a second voltage to the developer charging member, charges a polarity of a voltage difference between the first voltage and the second voltage opposite to a charging polarity of the developer, and recharges a polarity of the voltage difference as the charging polarity of the developer.

8. The image forming apparatus according to claim 7, wherein a developer image is formed by applying a developing voltage to the developer bearing body from the first power source and causing the developer, which is charged, to adhere to an electrostatic latent image formed on an image bearing body in the developing section.

9. The image forming apparatus according to claim 7, wherein the nondeveloping operation period corresponds to at least one of a prerotational operation period of an image bearing body before developing operation, and postrotational operation time of the image bearing body after the developing operation, and an interval until a start of a next developing operation.

10. The image forming apparatus according to claim 7, wherein the developer is nonmagnetic, one-component developer.

11. The image forming apparatus according to claim 7, wherein the developer bearing body is spaced apart from the image bearing body in the cleaning operation period.

12. An image forming apparatus comprising:

an image bearing body for bearing a latent image;

a developing apparatus for developing the latent image, the developing apparatus including:

a developer bearing body for bearing a developer and conveying the developer to a developing section; and a developer charging member for charging the developer borne by the developer bearing body;

a first power source for applying a developing voltage to the developer bearing body; and a second power source for applying a developer charging voltage to the developer charging member, wherein the developer charging member is provided at an upstream side of the developing section in a conveying direction of the developer borne by the developer bearing body, wherein the developer charging member is cleaned in a nondeveloping operation, wherein the developer borne by the developer bearing body is charged by applying a developer charging voltage with a same polarity as a polarity of the developing voltage from the second power source to the developer charging member, and wherein a second voltage applied from the second power source to the developer charging member in the nondeveloping operation period is lower than a discharging start voltage for the developer borne by the developer bearing body.

13. An image forming apparatus comprising:

an image bearing body for bearing a latent image;

a developing apparatus for developing the latent image, the developing apparatus including:

a developer bearing body for bearing a developer and conveying the developer to a developing section;

a developer charging member for charging the developer borne by the developer bearing body, a first power source for applying a developing voltage to the developer bearing body; and a second power source for applying a developer charging voltage to the developer charging member, wherein the developer charging member is provided at an upstream side of the developing section in a conveying direction of the developer borne by the developer bearing body, wherein the developer charging member is cleaned in a nondeveloping operation, wherein the developer borne by the developer bearing body is charged by applying a developer charging voltage with a same polarity as a polarity of the developing voltage from the second power source to the developer charging member, and wherein the nondeveloping operation period corresponds to a prerotational operation period of an image bearing body before developing operation.

14. A developing apparatus, comprising:

a developer bearing body for bearing developer and conveying the developer to a developing section;

a developer charging member for charging the developer borne by the developer bearing body, wherein a developer charging voltage is applied to the developer charging member; and control means for controlling an electrical field generated between the developer bearing body and the developer charging member, wherein the developing apparatus operates in a first direction period in which a direction of the electrical field in a nondeveloping operation period is reverse to a direction of the electrical field in a period when the developer charging voltage is applied to the developer charging member.

15. A developing apparatus according to claim 14, wherein the developing apparatus operates in a second direction period in which a direction of the electrical field after a reverse direction is a same direction as a direction of electrical field in a period when the developer charging voltage is applied to the developer charging member.

16. A developing apparatus according to any one of claims 14 and 15, wherein the developer charged with a regular polarity is collected from the developer bearing body and conveyed to the developer charging member in the first direction period.

17. A developing apparatus according to claim 15, wherein the developer charged with a regular polarity is collected from the developer bearing body and conveyed to the developer charging member in the reverse direction period, and is conveyed from the developer charging member to the developer bearing body in the second direction period.

18. A developing apparatus according to any one of claims 14 and 15, wherein the developer charging member is arranged at an upstream side of the developing section along a direction in which the developer bearing body conveys the developer.

19. A developing apparatus according to claim 18, further comprising a regulating member for regulating a thickness of a layer of the developer borne by the developer bearing body, wherein the developer charging member is arranged at a downstream side of a portion at which the regulating member regulates the layer along a direction in which the developer bearing body conveys the developer.

20. A developing apparatus according to claim 15, wherein, in the second direction period, a voltage applied to the developer charging member is lower than a discharging start voltage for the developer borne by the developer bearing body.

21. A developing apparatus according to any one of claims 15 and 20, wherein the developer charging voltage is higher than a discharging start voltage for the developer borne by the developer bearing body.

22. A developing apparatus according to any one of claims 14 and 15, wherein the developer bearing body develops an electroimage on an image bearing body with a developer, and wherein the nondeveloping operation period is a prerotational period for the image bearing body.

23. A developing apparatus according to any one of claims 14 and 15, wherein the developer bearing body develops an electrostatic image on an image bearing body with the developer, and wherein the nondeveloping operation period includes at least one of a prerotation operation period for the image bearing body, a postrotation operation period for the image bearing body, and a period between an image formation operation with the image bearing body and a next image formation operation.

24. A developing apparatus according to claim 14, wherein the developer charging member is a rotating body, and wherein length of duration in the first direction time is equal to or longer than a duration of one revolution that the rotation body rotates.

25. A developing apparatus according to claim 15, wherein the developer charging member is a rotating body, and wherein a length of a duration in the reverse direction period and the second direction period is equal to or longer than a duration of one rotation of the rotating body.

26. A developing apparatus according to any one of claims 14 and 15, wherein the developer is a nonmagnetic, one-component developer.

27. A developing apparatus apparatus, comprising:

a developer bearing body for bearing a developer and conveying the developer to a developing section;

a developer charging member for charging the developer borne by the developer bearing body, wherein a developer charging voltage is applied to the developer charging member; and control means for controlling an electrical field generated between the developer bearing body and the developer charging member, wherein a nondeveloping operation period includes a reverse direction period in which a direction of the electrical field is reverse to a direction of the electrical field in a period when the developer charging voltage is applied to the developer charging member.

28. A developing apparatus according to claim 27, wherein the nondeveloping operation period includes a second direction period in which a direction of the electrical field after the reverse direction period is a same direction as a direction of the electrical field in a period when the developer charging voltage is applied to the developer charging member.

29. A developing apparatus according to any one of claims 27 and 28, wherein the developer charged with a regular polarity is collected from the developer bearing body and conveyed to the developer charging member in the reverse direction period.

30. A developing apparatus according to claim 28, wherein the developer charged with a regular polarity is collected from the developer bearing body and conveyed to the developer charging member in the reverse direction period, and is conveyed from the developer charging member to the developer bearing body in the second direction period.

31. A developing apparatus according to any one of claims 27 and 28, wherein the developer charging member is arranged at an upstream side of the developing section along a direction in which the developer bearing body conveys the developer.

32. A developing apparatus according to claim 31, further comprising a regulating member for regulating a thickness of a layer of the developer borne by the developer bearing body, wherein the developer charging member is arranged at a downstream side of a portion of the apparatus at which the regulating member regulates the layer of the developer along a direction in which the developer bearing body conveys the developer.

33. A developing apparatus according to claim 28, wherein, in the second direction period, a voltage applied to the developer charging member is lower than a discharge start voltage for the developer borne by the developer bearing body.

34. A developing apparatus according to any one of claims 28 and 33, wherein the developer charging voltage is higher than a discharge start voltage for the developer borne by the developer bearing body.

35. A developing apparatus according to any one of claims 27 and 28, wherein the developer bearing body develops an electrostatic image formed on an image bearing body with the developer, and wherein the nondeveloping operation period is a prerotation period for the image bearing body.

36. A developing apparatus according to any one of claims 27 and 28, wherein the developer bearing body develops an electrostatic image formed on an image bearing body with the developer, and wherein the nondeveloping operation period includes at least one of a prerotation operation period for the image bearing body, a postrotation operation period for the image bearing body, and a period between an image formation operation with the image bearing body and a next image formation operation.

37. A developing apparatus according to claim 27, wherein the developer charging member is a rotating body, and wherein a length of a duration in the reverse direction period is equal to or loner than a length of a duration of one rotation of the rotating body.

38. A developing apparatus according to claim 28, wherein the developer charging member is a rotating body, and wherein a length of a duration in the reverse direction period, and the second direction period is equal to or longer than a length of a duration of one rotation of the rotating body.

39. A developing apparatus according to any one of claims 27 and 28, wherein the developer is a nonmagnetic, one-component developer.

* * * * *

UNITED STATES PATENT AND TRADEMARK OFFICE

CERTIFICATE OF CORRECTION

PATENT NO. : 6,522,842 B1
DATED : February 18, 2003
INVENTOR(S) : Shinji Uehara et al.

It is certified that error appears in the above-identified patent and that said Letters Patent is hereby corrected as shown below:

Title page,
Item [57], ABSTRACT,
Line 13, "and" should read -- and a --.

Column 1,
Line 59, "rotate" should read -- rotated --.
Line 61, "contacts to" should read -- contact --.
Lines 63 and 65, "to" should be deleted.

Column 2,
Line 16, "is" should read -- that is --.
Line 18, "to" should be deleted.

Column 3,
Line 18, "operation" should read -- operations --.
Line 35, "to" should be deleted.
Line 37, "Other" should read -- Another --.
Line 61, "to" should be deleted.

Column 4,
Line 25, "accord" should read -- according --.

Column 6,
Line 11, "rotate" should read -- rotated --.
Lines 13, 15, 17 and 19, "to" should be deleted.

Column 8,
Line 14, "become" should read -- becomes --.
Line 16, "As" should read -- As for --.
Line 57, "triboelectrifies" should read -- triboelectrified --.

Column 9,
Line 64, "to" should be deleted.

Column 10,
Lines 35 and 59, "to" should be deleted.

Column 13,
Line 22, "increases," should read -- increase, --.

UNITED STATES PATENT AND TRADEMARK OFFICE

CERTIFICATE OF CORRECTION

PATENT NO. : 6,522,842 B1
DATED : February 18, 2003
INVENTOR(S) : Shinji Uehara et al.

It is certified that error appears in the above-identified patent and that said Letters Patent is hereby corrected as shown below:

Column 14,
Lines 2 and 9, "an" should read -- a --.
Line 28, "increases," should read -- increase, --.
Line 54, "operation" should read -- operations --.

Column 15,
Line 2, "to" should be deleted.
Line 11, "to" should read -- to be --.
Line 17, "to" should be deleted.
Line 67, "and" should be deleted.

Column 16,
Line 37, "operation" should read -- operation, --.
Line 45, "bearing" should read -- bearing a --.

Column 17,
Line 24, "and" should be deleted.
Line 27, "bearing" should read -- bearing a --.
Line 28, "section;" should read -- section; and --.
Line 39, "member;" should read -- member; and --.
Line 66, "before" should read -- before a --; and "and" should read -- a --.
Line 67, "time" should read -- period --.

Column 18,
Line 43, "section;" should read -- section; and --.
Line 64, "before" should read -- before a --.
Line 66, "bearing" should read -- bearing a --.

Column 19,
Line 56, "troimage" should read -- trostatic image --.

Column 20,
Line 6, "length of" should read -- a length of a --; and "first direction time" should read -- reverse direction period --.
Line 7, "than" should read -- than a length of --; and "revolution that" should read -- rotation of --.
Line 8, should read -- rotating body. --.
Line 13, "than" should read -- than a length of --.
Line 17, "apparatus" should be deleted.

UNITED STATES PATENT AND TRADEMARK OFFICE

CERTIFICATE OF CORRECTION

PATENT NO. : 6,522,842 B1
DATED : February 18, 2003
INVENTOR(S) : Shinji Uehara et al.

It is certified that error appears in the above-identified patent and that said Letters Patent is hereby corrected as shown below:

Column 22,
Line 6, "loner" should read -- longer --.

Signed and Sealed this

Fourth Day of November, 2003

JAMES E. ROGAN
*Director of the United States Patent and Trademark Office*